US009181781B2

(12) United States Patent
Agrawal et al.

(10) Patent No.: US 9,181,781 B2
(45) Date of Patent: Nov. 10, 2015

(54) METHOD OF MAKING AND USING A RECONFIGURABLE DOWNHOLE ARTICLE

(75) Inventors: Gaurav Agrawal, Aurora, CO (US); Zhiyue Xu, Cypress, TX (US); Ping Duan, Cypress, TX (US); James Goodson, Porter, TX (US); James B. Crews, Willis, TX (US)

(73) Assignee: Baker Hughes Incorporated, Houston, TX (US)

( * ) Notice: Subject to any disclaimer, the term of this patent is extended or adjusted under 35 U.S.C. 154(b) by 1028 days.

(21) Appl. No.: 13/173,944

(22) Filed: Jun. 30, 2011

(65) Prior Publication Data

US 2013/0004664 A1 Jan. 3, 2013

(51) Int. Cl.

| | |
|---|---|
| ***B22F 1/02*** | (2006.01) |
| ***E21B 41/00*** | (2006.01) |
| ***E21B 43/08*** | (2006.01) |
| ***E21B 43/12*** | (2006.01) |

(52) U.S. Cl.
CPC ..... *E21B 41/00* (2013.01); *E21B 43/08* (2013.01); *E21B 43/12* (2013.01)

(58) Field of Classification Search
CPC ..... E21B 41/00; B22F 1/25
USPC ..... 419/2
See application file for complete search history.

(56) References Cited

U.S. PATENT DOCUMENTS

| | | | | |
|---|---|---|---|---|
| 3,573,071 | A | 3/1971 | Horton et al. | |
| 3,852,045 | A * | 12/1974 | Wheeler et al. | 428/566 |
| 3,990,903 | A | 11/1976 | Mallow | |
| 4,828,771 | A | 5/1989 | Kishima | |
| 4,829,152 | A * | 5/1989 | Rostoker et al. | 219/78.02 |
| 5,039,645 | A | 8/1991 | Elliott | |
| 5,425,424 | A | 6/1995 | Reinhardt et al. | |
| 5,479,986 | A | 1/1996 | Gano et al. | |

(Continued)

FOREIGN PATENT DOCUMENTS

WO 2010076344 A1 7/2010

OTHER PUBLICATIONS

Araki, Kiyoshi and Halloran, John: "Ceramic Freeze Casting Technique with Sublimable Vehicles", University of Michigan Department of Materials Science and Engineering, 105th Annual Meeting of the ACerS Apr. 29, 2003.

(Continued)

*Primary Examiner* — Jessee Roe
*Assistant Examiner* — Christopher Kessler
(74) *Attorney, Agent, or Firm* — Cantor Colburn LLP

(57) ABSTRACT

A method of making a reconfigurable article is disclosed. The method includes providing a powder comprising a plurality of base material particles. The method also includes providing a powder comprising a plurality of removable material particles; and forming a base article from the base material comprising a plurality of removable material particles. A method of using a reconfigurable article is also disclosed. The method includes forming a base article, the base article comprising a base material and a removable material, wherein the base article comprises a downhole tool or component. The method also includes inserting the base article into a wellbore. The method further includes performing a first operation utilizing the base article; exposing the removable material of the base article to a wellbore condition that is configured to remove the removable material and form a modified article; and performing a second operation using the article.

15 Claims, 12 Drawing Sheets

(56) References Cited

U.S. PATENT DOCUMENTS

| | | | |
|---|---|---|---|
| 5,529,123 | A | 6/1996 | Carpenter et al. |
| 5,685,372 | A | 11/1997 | Gano |
| 5,765,641 | A | 6/1998 | Shy et al. |
| 6,161,622 | A | 12/2000 | Robb |
| 6,202,751 | B1 | 3/2001 | Chatterji et al. |
| 6,288,174 | B1 | 9/2001 | Ikegami et al. |
| 6,364,945 | B1 | 4/2002 | Chatterji |
| 6,761,218 | B2 | 7/2004 | Nguyen |
| 7,032,663 | B2 | 4/2006 | Nguyen |
| 7,044,224 | B2 | 5/2006 | Nguyen |
| 7,093,664 | B2 | 8/2006 | Todd et al. |
| 7,156,174 | B2 | 1/2007 | Roddy et al. |
| 7,461,699 | B2 | 12/2008 | Richard et al. |
| 7,497,258 | B2 | 3/2009 | Savery |
| 7,527,103 | B2 | 5/2009 | Huang et al. |
| 7,637,319 | B2 | 12/2009 | Savery |
| 7,640,985 | B2 | 1/2010 | Savery |
| 7,762,342 | B2 | 7/2010 | Richard et al. |
| 7,775,286 | B2 | 8/2010 | Duphorne |
| 7,784,542 | B2 | 8/2010 | Roddy et al. |
| 7,900,696 | B1 | 3/2011 | Nish et al. |
| 7,909,096 | B2 | 3/2011 | Clark et al. |
| 8,047,288 | B2 | 11/2011 | Skala et al. |
| 8,157,009 | B2 | 4/2012 | Patil et al. |
| 8,220,538 | B2 | 7/2012 | Wee |
| 8,220,835 | B2 | 7/2012 | Green |
| 8,342,240 | B2 | 1/2013 | Richard |
| 8,377,278 | B1 | 2/2013 | Cardenas |
| 8,425,651 | B2 | 4/2013 | Xu |
| 8,586,512 | B2 | 11/2013 | Roddy et al. |
| 8,672,041 | B2 | 3/2014 | Duphorne |
| 2003/0230407 | A1 | 12/2003 | Vijn |
| 2004/0231845 | A1 | 11/2004 | Cooke, Jr. |
| 2005/0092363 | A1 | 5/2005 | Richard |
| 2005/0145141 | A1 | 7/2005 | Nguyen et al. |
| 2005/0167105 | A1 | 8/2005 | Roddy et al. |
| 2007/0017675 | A1 | 1/2007 | Hammami |
| 2007/0107908 | A1 | 5/2007 | Vaidya et al. |
| 2008/0149345 | A1 | 6/2008 | Marya |
| 2008/0153940 | A1 | 6/2008 | Scheer et al. |
| 2008/0246174 | A1 | 10/2008 | Danican et al. |
| 2008/0296024 | A1 | 12/2008 | Huang et al. |
| 2009/0124522 | A1 | 5/2009 | Roddy |
| 2009/0137433 | A1 | 5/2009 | Smith et al. |
| 2009/0255686 | A1 | 10/2009 | Richard et al. |
| 2010/0016183 | A1 | 1/2010 | Roddy et al. |
| 2010/0139919 | A1 | 6/2010 | Yeh et al. |
| 2010/0272649 | A1 | 10/2010 | Nies et al. |
| 2010/0294510 | A1 | 11/2010 | Holmes |
| 2011/0024114 | A1 | 2/2011 | Ghassemzadeh |
| 2011/0077176 | A1 | 3/2011 | Smith et al. |
| 2011/0107942 | A1 | 5/2011 | Eleto Da Silva et al. |
| 2011/0311719 | A1 | 12/2011 | Bicerano |
| 2012/0031308 | A1 | 2/2012 | Fradera Pellicer |
| 2012/0211239 | A1 | 8/2012 | Kritzler et al. |
| 2012/0247765 | A1 | 10/2012 | Agrawal et al. |
| 2012/0276356 | A1 | 11/2012 | Xu et al. |
| 2013/0000903 | A1 | 1/2013 | Crews |
| 2013/0000985 | A1 | 1/2013 | Agrawal |
| 2013/0004664 | A1 | 1/2013 | Agrawal |
| 2014/0124215 | A1 | 5/2014 | Duphorne |

OTHER PUBLICATIONS

Nie, Xiaowu, "Patents of Methods to Prepare Intermetallic Matrix Composites: A Review", Recent Patents on Materials Science, 2008, 1, 232-240.

B. Vidick, S. James and B. Drochon; "An Alternative to Sand-Control Screens: Is Permeable Cement a Viable Option?"; SPE Drilling & Completion, Sep. 2008, pp. 229-234.

* cited by examiner

40

METHOD OF MAKING AND USING A RECONFIGURABLE DOWNHOLE ARTICLE

CROSS REFERENCE TO RELATED APPLICATIONS

This application contains subject matter related to the subject matter of co-pending U.S. patent application Ser. No. 13/173,992 filed on Jun. 30, 2011; which is incorporated herein by reference in its entirety.

BACKGROUND

In the well drilling, completion and production arts, it is frequently desirable to employ articles, such as downhole tools and components, which can be reconfigured in the downhole environment to perform more than one function. For example, it may be desirable for a downhole article to have one configuration during one operation, such as drilling, and another configuration during other operations, such as completion or production.

SUMMARY

In an exemplary embodiment, a method of making a reconfigurable article is disclosed. The method includes providing a powder comprising a plurality of base material particles. The method also includes providing a powder comprising a plurality of removable material particles. The method further includes forming a base article from the base material comprising a plurality of removable material particles.

In another exemplary embodiment, a method of using a reconfigurable article is disclosed. The method includes forming a base article, the base article comprising a powder compact of a base material and a removable material, wherein the base article comprises a downhole tool or component. The method also includes inserting the base article into a wellbore. The method further includes performing a first operation utilizing the base article. Still further, the method includes exposing the removable material of the base article to a wellbore condition that is configured to remove the removable material and form a modified article. Yet further, the method includes performing a second operation using the modified article.

BRIEF DESCRIPTION OF THE DRAWINGS

Referring now to the drawings wherein like elements are numbered alike in the several Figures.

DETAILED DESCRIPTION

Figure 1A:
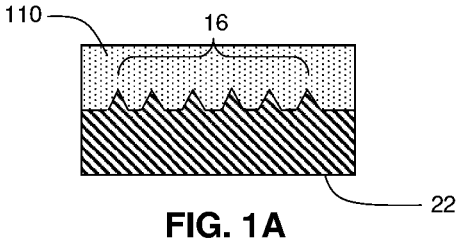
FIGS. 1A-1D are schematic cross-sectional illustrations of an exemplary embodiment of a reconfigurable article and method of using the reconfigurable article as disclosed herein.

Referring to the Figures, reconfigurable articles 10 and a method of making 300 and method of using 400 reconfigurable articles 10 are disclosed. The methods may be used to make and use reconfigurable articles for any application, but are particularly useful for making various reconfigurable downhole articles 10, including downhole tools and components, for use in well drilling, completion and production operations. Even more particularly, the methods are useful for making articles 10 that can be used downhole by being reconfigured to provide a predetermined porosity 11, including a surface porosity 12, or internal porosity 14, or a combination thereof, surface texture 16, or substantially closed cavity 18, or combinations thereof. The reconfigurable articles comprise base articles 20 with base features and performance characteristics that can be reconfigured to provide modified articles 40 that have different features and performance characteristics, and more particularly the predetermined surface porosity 12, internal porosity 14, surface texture 16, or substantially closed cavity 18, or combinations thereof, described herein. The method of making is used to make a base article 20 of a base material 22. The base article 20 also includes a removable material 24 that enables reconfiguration of the base article 20 to form a modified article 40 that includes the predetermined surface porosity 12, internal porosity 14, surface texture 16, or substantially closed cavity 18, or combinations thereof, described herein. The method of using 400 includes reconfiguring the base article 20 to form the modified article 40, and more particularly placing a base article 20 comprising a downhole tool or component downhole as part of a well drilling, completion or production operation and then reconfiguring the base article 20 to form the modified article 40. Reconfiguring the base article 20 to form the modified article 40 may be performed in any suitable manner, and more particularly may include exposing the base article 20 to a suitable wellbore condition 50, including a temperature 52, pressure 54 or chemical 56 condition, or a combination thereof, to remove the removable material 24, including removal by various dissolution or corrosion processes, and even more particularly by exposure of a base downhole tool or component to a wellbore fluid 60 to remove the removable material 24 by dissolution or corrosion. These and other aspects of the reconfigurable articles and method of making 300 and method of using 400 them are described further below.

Referring to the figures, and more particularly to FIG. 1A-5E, in an exemplary embodiment, a reconfigurable downhole article 10 includes a base material 22 and a removable material 24. The removable material 24 may be disposed on or within the base material 22 and is configured for removal from the base material 22 in response to a wellbore condition 50. The base material 22 and the removable material 24 define a base article 20 that is configured to perform a first function in the wellbore. Upon removal of the removable material 24, the base material 22 defines a modified article 40 that is configured to perform a second function that may be different than the first function. In an exemplary embodiment, the base article 20 may include a first downhole tool or component that is configured to perform a first function and the modified article 40 may include a second downhole tool or component that has a feature that is not found in the base article 20 and that is configured to perform a second function. As an example, the base material 22 may define a base article 20 that includes a solid wall section 28 or surface 30 of the base article 20 that includes the base material 22 and the removable material 24. Upon removal of the removable material 24, the modified article 40 may include a feature (or plurality of features) not found in the base article 20 that enable the modified article 40 to perform a function (or plurality of functions different than those of the base article 20, such as a wall section that includes at least one of a predetermined surface texture 16 in the base material 22 as shown in FIGS. 1A-1D, a predetermined porosity 11 in the base material 22 as shown in FIGS. 2A-2D (surface porosity 12) and 3A-3D (internal porosity 14), or a substantially closed cavity 18 in the base material 22 that was not present in the base article 20 as shown in FIG. 4A-4E, or combinations of these features. In another exemplary embodiment, a reconfigurable downhole article 10 that includes a base article 20 and a modified article 40 may also be described in the following manner. The base article 20 includes a base material 22 and a removable material 24, the removable material 24 includes a substantially-continuous, cellular nanomatrix 216 comprising a nanomatrix material 220, a plurality of dispersed particles 214 comprising a particle core material 118 that comprises Mg, Al, Zn, Fe or Mn, or a combination thereof, as described herein, dispersed in the cellular nanomatrix 216; and a bond layer extending throughout the cellular nanomatrix 216 between the dispersed particles. The reconfigurable article 10 also includes a modified article 40 comprising the base material 22, wherein the base article 20 is configured for irreversible transformation to the modified article 40 by removal of the removable material 24.

Figure 1B:
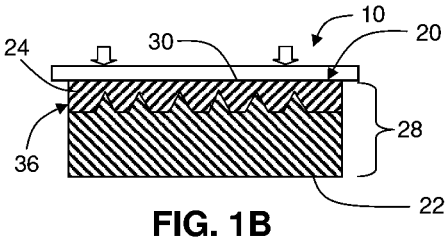
Figure 1C:
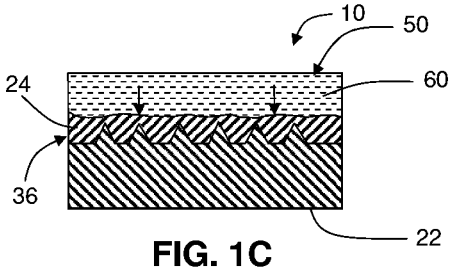
Figure 1D:
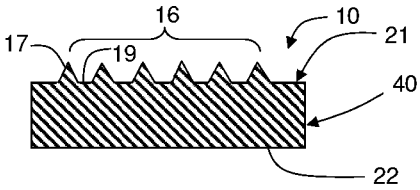

In one embodiment, a predetermined surface texture 16 may be preformed in a surface of the base material 22 and covered by application of the removable material 24, such as by compacting a powder 110 of a removable material 24 on the predetermined surface texture 16 of the base material 22 as shown in FIG. 1A to provide a compacted layer of the removable material 24 on the predetermined surface texture 16 of the base material 22 and define the base article 20, as shown in FIG. 1B. The powder 110 may be compacted by a compacting or pressing device 27, such as an isostatic press, platen, roller or the like. This may be followed by exposure to a predetermined wellbore condition 50, such as a predetermined wellbore fluid 60, as shown in FIG. 1C, to cause the removal of the removable material 24 to expose the predetermined surface texture 16 and define a modified article 40, as shown in FIG. 1D. The removable material 24 may include a powder compact 36, which may be sintered or unsintered, disposed on the base material 22. The powder compact 36 may be compacted to substantially full theoretical density or may be compacted to less than full theoretical density and contain porosity associated with having been compacted to less than full theoretical density. The predetermined surface texture 16 may be any suitable texture, including protruding and/or recessed features in any suitable pattern or random orientation. In FIGS. 1A-1D, the predetermined surface texture includes a pattern of protrusions or ridges 17 or grooves and corresponding valleys 19, but any suitable predetermined surface texture 16 may be formed. This may include, for example, all manner of threads, knurling, dimples, bumps and the like that may be used to provide a friction control surface 21. The removable material 24 may be used, for example to cover, conceal, protect or otherwise enclose the predetermined surface texture 16 until its use is desired in conjunction with a wellbore operation.

Figure 5A:
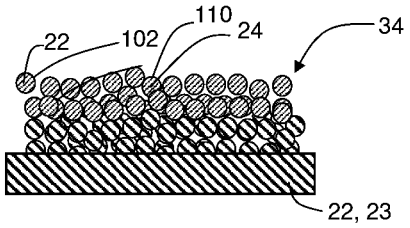
FIGS. 5A-5D are schematic cross-sectional illustrations of a fifth exemplary embodiment of a reconfigurable article and method of using the reconfigurable article as disclosed herein.
Figure 5B:
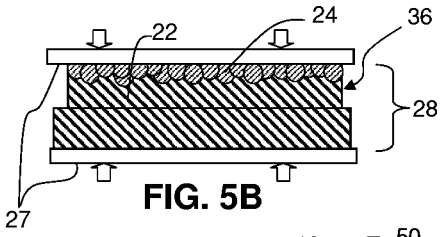
Figure 5C:
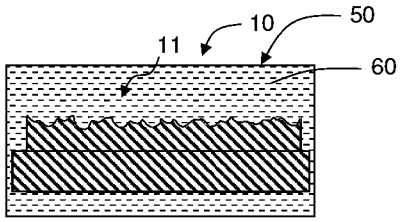
Figure 5D:
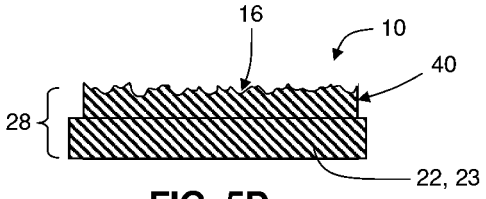

In another embodiment, the removable material 24 and base material 22 may be applied together to a surface of a substrate that does not include a predetermined surface texture 16, such as by compacting a powder of the removable material 24 and base material 22 on a substrate of the base material 22 as shown in FIG. 5A to provide a compacted layer of the removable material 24 and base material 22 on the substrate and define the base article 20 as shown in FIG. 5B followed by exposure to a predetermined wellbore condition 50, such as a predetermined wellbore fluid 60, as shown in FIG. 5C to cause the removal of the removable material 24 to expose the predetermined surface texture 16 in the exposed surface of the layer of the base material 22 and define the modified article 40 as shown in FIG. 5D. For example, compacting a removable material 24 powder together with a base material 22 powder followed by removal of the removable material 24 will leave an exposed surface in the base material 22 that includes the impressions of the removable material 24 particles, such as a surface having a pattern of dimples reflecting the approximate size (e.g., diameter) of the removable powder particles as well as the size of the base material particles as shown schematically in FIG. 5D, which may have any suitable size range from nanometer or micrometer size particles, or even larger particles depending on the surface texture 16 desired. The predetermined surface texture 16 may include any suitable surface texture 16, including all manner of surface textures 16 to define a friction control surface 32, for example, such as predetermined surface roughnesses, knurling patterns and all manner of patterns of protrusions, recesses, or a combination thereof. The predetermined surface texture 16 may be used with all manner of downhole articles, particularly downhole tools and components, including as various sleeves, tubulars and the like as described herein.

Figure 2A:
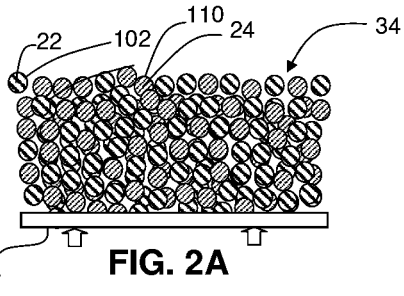
FIGS. 2A-2D are schematic cross-sectional illustrations of a second exemplary embodiment of a reconfigurable article and method of using the reconfigurable article as disclosed herein.
Figure 2B:
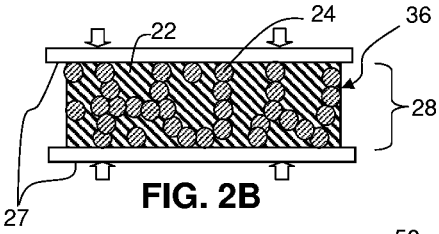
Figure 2C:
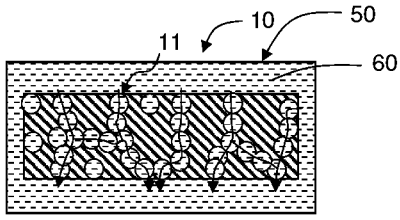
Figure 2D:
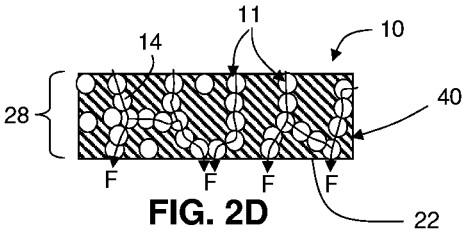
Figure 3A:
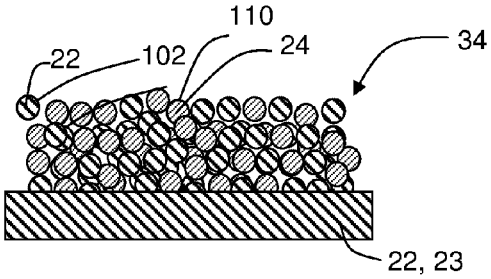
FIGS. 3A-3D are schematic cross-sectional illustrations of a third exemplary embodiment of a reconfigurable article and method of using the reconfigurable article as disclosed herein.
Figure 3B:
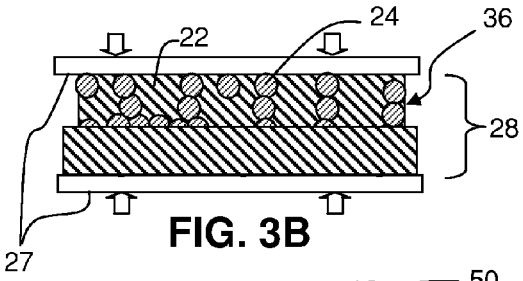
Figure 3C:
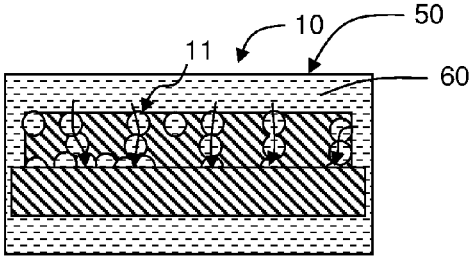
Figure 3D:
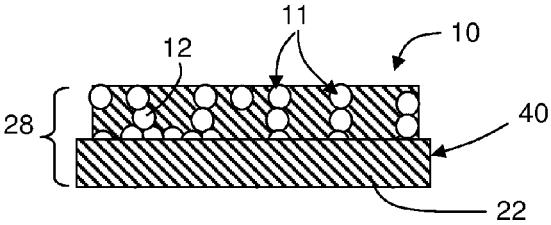

In another embodiment, a predetermined porosity 11 may be formed by forming a suitable mixture, such as a powder mixture 34 comprising powders of the removable material 24 and the base material 22 as shown in FIGS. 2A and 3A, compacting the mixture of the powders using a suitable compacting or pressing device 27 to form a powder compact 36 as shown in FIGS. 2B and 3B, followed by exposure to a predetermined wellbore condition 50, such as a predetermined wellbore fluid 60, as shown in FIGS. 2C and 3C, to cause the removal of the removable material 24 and define the modified article 40 as shown in FIGS. 2D and 3D. The remaining base material 22 has a predetermined porosity 11 defined by the space formerly occupied by the removable material 24. Where the base material 22 and removable material 24 powders comprise a homogeneous mixture, the porosity in the base material 22 will be homogeneous. If the mixture is heterogeneous, the porosity will also be heterogeneous. The powder compact of the mixture of the removable material 24 and base material 22 may include a sintered or unsintered powder compact. The powder compact may be compacted to substantially full theoretical density or may be compacted to less than full theoretical density and contain porosity associated with having been compacted to less than full theoretical density. The modified article 40 may comprise a stand-alone component as illustrated in FIGS. 2A-2D, or may be disposed, attached to or otherwise associated with another article 23 as a substrate, as described herein as illustrated in FIGS. 3A-3D. In one embodiment, the predetermined porosity 11 may include porosity formed on one or more surfaces of the modified article 40 as illustrated in FIG. 3D. Such an embodiment of a modified article 40 may be useful in reconfigurable articles 10 where it is desirable to use the surface porosity 12 to hold or retain a fluid therein, such as a bearing having a porous surface to retain a lubricant therein. It may also be useful to retain a fluid that can be activated to selectively enable or restrict movement, such as a magnetorheological (MR) or electrorheological (ER) fluid, which may be used, for example, to form a brake member or a clutch member. In another embodiment, the predetermined porosity 11 may include internal porosity 14 that extends from a first surface 42 through a wall section of the article to a second surface 44. In certain embodiments, the internal porosity 14 may provide a network 90 of porosity that provides a tortuous fluid flow path for a fluid (F), such as an open cell network 90 of pores that provide a plurality of paths through modified article 40 as illustrated in FIG. 2D. Such an embodiment may be used to define a fluid permeable wall or porous barrier, and may also serve as a screen or filter with regard to the movement of fluids within the wellbore through the wall section that may contain particulates as illustrated in FIG. 2D. The characteristics of the porosity that may be formed, including the pore size, will be determined by relative sizes and amounts (e.g., volume percent) of the particles of the base material 22 and removable material 24 used. In one embodiment, the powder particles of the removable material 24 may comprise particles having an average particle size defining nanometer (e.g., about 1 to about 1000 nm) and micrometer (e.g., about 1 to about 1000 micrometer) size powder particles. In other embodiments, the removable material 24 may comprise much larger particles, including those that have an average particle size defining millimeter (e.g., about 1 to about 50 mm) size powder particles or pellets, that may themselves be formed, for example, as powder compacts 200 of smaller particle size powders, as described herein. The removable material 24 particles may have any suitable shape. They may include all manner of shapes, including spherical or non-spherical particle shapes, and may also include elongated shapes, including rods; plates; wires or fibers, including continuous and discontinuous wires or fibers; and the like. Similarly, the base materials 22 particles may have any suitable size and shape, including those described above for the removable materials 24.

Figure 4A:
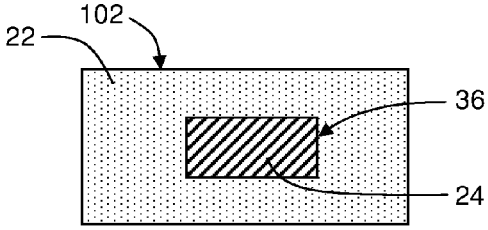
FIGS. 4A-4E are schematic cross-sectional illustrations of a fourth exemplary embodiment of a reconfigurable article and method of using the reconfigurable article as disclosed herein.
Figure 4B:
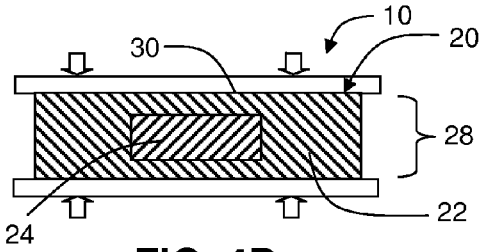
Figure 4C:
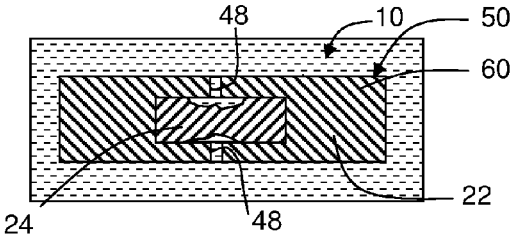
Figure 4D:
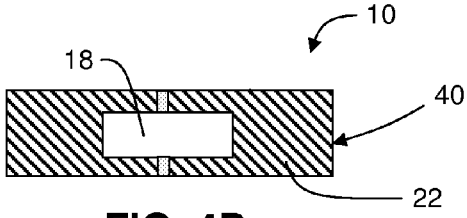
Figure 4E:
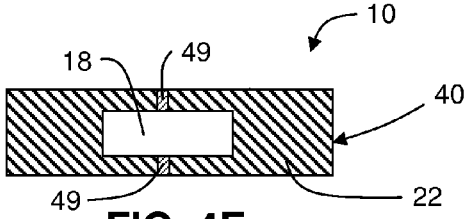

As indicated, the base material 22 and removable material 24 may be selected to produce relatively small size porosity, or microporosity, reflective of small size particles of the removable material 24 including nanometer and micrometer size porosity, but may also be selected to produce relatively large size porosity, or macroporosity, reflective of millimeter or larger size particles, or inserts of any size or shape that are partially or completely embedded within the base material 22 and that may be removed to form various features in the base material. In yet another embodiment, the removable material 24 may be used to define a substantially closed cavity 18 of any predetermined size or shape form. This is very advantageous, since forming substantially closed cavities can be very difficult to achieve using conventional forming methods including various forms of molding, casting and the like, due to the necessity of defining the mold with a parting line associated with the cavity or trying to remove a casting pattern from the substantially closed pattern. A substantially closed cavity 18 may be formed as disclosed herein by forming a powder compact that includes a pocket or cavity, such as a predetermined shape preform, of the removable material 24 substantially encompassed within the base material 22. This may be accomplished, for example, by forming a sintered or unsintered powder compact of the removable material 24 and disposing it within the base material 22, such as a powder of the base material 22, as shown in FIG. 4A. Alternately, a non-compacted powder of the removable material 24 may be disposed within the powder 102 of the base material 22 (not shown) where it can be compacted together with the powder 102 of the base material 22. The powder compact of the removable material 24 disposed within the powder of the base material 22 may be compacted as shown in FIG. 4B, either with or without heating to provide a sintered or unsintered compact of the base material 22 and removable material 24, respectively. Removal of the removable material 24 in response to a wellbore condition 50, such as exposure to a wellbore fluid 60, as shown in FIG. 4C provides a powder compact, either sintered or unsintered, of base material 22 having a substantially closed cavity 18 as shown in FIG. 4D. If the powder compact of the base material 22 having the substantially closed cavity 18 is unsintered, the unsintered article may be heated sufficiently to sinter the modified article 40. As used herein, substantially closed is used to indicate that removal of the removable material 24 is performed by providing access of a fluid, such as a wellbore fluid 60, to the removable material 24 through some form of opening or access 48 through the base material 22 to the removable material 24, either by forming such an opening or access to the cavity directly in the powder compact, or by removing material by drilling or otherwise to provide such an opening or access 48. A modified article 40 having a fully closed cavity 18 may be obtained by filling the opening or access 48 using any suitable filler material 49 and process, such as by welding, after the removable material 24 has been removed as illustrated in FIG. 4E. A substantially closed or fully closed cavity 19 may be used, for example, to reduce the weight of a downhole article, or to provide an integral diaphragm or for other purposes.

The base material 22 may include any material suitable for forming the base article 20 and modified article 40, particularly where these article are intended for use a various downhole tools or components. The base material 22 may include a metal, ceramic, polymer, inorganic compound, cement, mortar or concrete, or a combination thereof, as described herein.

Suitable metals include alloys typically employed in a wellbore environment to form downhole tools and components, including various tubulars, sleeves, slips and other downhole articles. These metals may include various pure metals and metal alloys, including various grades of steel, particularly various grades of stainless steel. Other suitable alloys include various Fe-base, Ni-base and Co-base alloys and superalloys.

Suitable polymers include polymers typically employed in a wellbore environment to form downhole tools and components, including various packings, seals and other articles. Suitable polymers may include any polymer that provides low permeability to the predetermined wellbore fluid 60 for a time sufficient to function as the base material 22 as described herein. Suitable polymers may include various natural polymers, synthetic polymers, blends of natural and synthetic polymers, and layered versions of polymers, wherein individual layers may be the same or different in composition and thickness. Suitable polymers may include composite polymeric compositions, such as, but not limited to, polymeric compositions having various fillers, plasticizers, and fibers therein. Suitable synthetic polymeric compositions include those selected from thermoset polymers and non-thermoset polymers having various polymeric structures, including various cross-linked structures. Examples of suitable non-thermoset polymers include thermoplastic polymers, such as polyolefins, polytetrafluoroethylene, polychlorotrifluoroethylene, and thermoplastic elastomers. Elastomers may include natural and man-made elastomers, and may be thermoplastic elastomers or a non-thermoplastic elastomers. The term includes blends (physical mixtures) of elastomers, as well as copolymers, terpolymers, and multi-polymers. Elastomers may also include one or more additives, fillers, plasticizers, and the like. Examples of thermoplastic compositions suitable for use include polycarbonates, polyetherimides, polyesters, polysulfones, polystyrenes, acrylonitrile-butadiene-styrene block copolymers, acetal polymers, polyamides, or combinations thereof, in any morphological configuration, and more particularly may include various cross-linked formulations of these polymers, and even more particularly may include cross-linked polyethersulfones. Suitable thermoset (thermally cured) polymers include bismaleimids, epoxides, phenolics, polyesters, polyimides, polyurethanes or silicones, or composites thereof, or combinations thereof.

Suitable ceramics include ceramics typically employed in a wellbore environment to form downhole tools and components, including various sleeves and other downhole articles. Suitable ceramics may include metal carbides, oxides or nitrides, or combinations thereof, including tungsten carbide, silicon carbide, boron carbide, alumina, zirconia, chromium oxide, silicon nitride or titanium nitride.

Suitable cements, mortars and concretes include those typically employed in a wellbore environment to form downhole tools and components, including various casings, seals, plugs, packings, liners and the like. Various hydraulic cements and mortars are suitable in the compositions and methods disclosed herein, including those comprised of calcium, aluminum, silicon, oxygen, and/or sulfur, which set and harden by reaction with water. Such hydraulic cements include, but are not limited to, Portland cements, pozzolana cements, gypsum cements, high alumina content cements, silica cements, and high alkalinity cements. Portland cements are particularly useful. In some embodiments, the Portland cements that are suited for use are classified as Class A, B, C, G, and H cements according to American Petroleum Institute, API Specification for Materials and Testing for Well Cements. The teaching herein related to cement compositions may also be used for many mortar compositions for substituting the reference to "cement" for "mortar".

Certain low-density cements may also be used, including foamed cements or cements whose density has been reduced by another means including microspheres, low-density polymer beads, or other density-reducing additives. If a low-density cement is utilized, then a mixture of foaming and foam stabilizing dispersants may also be used. Generally, the mixture may be included in the cement compositions of the present invention in an amount in the range of from about 1% to about 5% by volume of water in the composition. Low-density cements may be used to reduce the potential of fracturing the walls of the wellbore during placement of the cement in the annulus, for example. The cement component of the compositions of the present invention may include about 30% to about 70% of the weight of the composition, preferably from about 50% to about 60%. In on embodiment, the removable material may be substituted for the cement component of the cement composition in an amount of about 1 to about 70% of the cement component, and more particularly about 10 to about 65% of the cement component. The water utilized in the cement compositions of this invention can be fresh water, salt water (e.g., water containing one or more salts dissolved therein), brine (e.g., saturated salt water), or seawater. Generally, the water can be from any source provided that it does not contain an excess of compounds that adversely affect other components in the permeable cement composition. The water preferably is present in an amount sufficient to form a pumpable slurry. More particularly, the water is present in the cement compositions in an amount in the range of from about 15% to about 50% by weight of hydraulic cement therein, more preferably in an amount of about 20% to about 40%. Optionally, a dispersant may be included in the cement compositions of the present invention. If used, the dispersant should be included in the composition in an amount effective to aid in dispersing the cement and the removable material 24 within the composition. In certain embodiments, about 0.1% to about 5% dispersant by weight of the composition is suitable. In other embodiments, a different range may be suitable. Examples of suitable dispersants include but are not limited to naphthalene sulfonate formaldehyde condensates, acetone formaldehyde sulfite condensates, and glucan delta lactone derivatives. Other dispersants may also be used depending on the application of interest. In order to control fluid loss from a cement composition of this invention during placement, a fluid loss control additive can be included in the composition. Examples of suitable cement slurry fluid loss control additives include those that are liquids or can be dissolved or suspended in liquids. These include but are not limited to modified synthetic polymers and copolymers, natural gums and their derivatives, derivatized cellulose, and starches. Other fluid loss control additives may be suitable for a given application, including amounts ranging from about 0% to about 25% by weight of the cement composition. Other additives such as accelerators (such as triethanolamines, calcium chloride, potassium chloride, sodium formate, sodium nitrate, and other alkali and alkaline earth metal halides, formates, nitrates, sulfates, and carbonates), retardants (such as sodium tartrate, sodium citrate, sodium gluconate, sodium itaconate, tartaric acid, citric acid, gluconic acid, lignosulfonates, and synthetic polymers and copolymers), extenders, weighting agents, thixotropic additives, suspending agents, or the like may also be included in the cement compositions disclosed herein. The cements described herein also may encompass various concretes by the further addition of aggregates, such as a coarse aggregate made of gravel or crushed rocks such as limestone, or granite, and/or a fine aggregate such as sand. Aggregate may be added in an amount of about 10% to 70% of the cement composition, and more particularly about 20% to 40%. The removable material may also be substituted for a portion of the aggregate, including the same ranges described above as may be substituted for the cement component.

The base material 22 will preferably have a substantially lower corrosion rate in response to a predetermined wellbore condition 50, such as a predetermined wellbore fluid 60, than the removable material 24. This enables the selective and rapid removal of the removable material 24 to form the modified article 40 and form the features described above, while allowing the modified article 40 comprising the base material 22 to be utilized for its intended function for a predetermined period of time including an operating lifetime or critical service time. In one embodiment, the difference in the corrosion rates of the removable materials 24 and the base material 42 allows the modified article 40, such as a downhole article 10, to be utilized for its intended purpose, such as a specific wellbore operation, in the presence of the predetermined wellbore fluid 60 and provides an operating lifetime or critical service time in the predetermined wellbore fluid 60 that is sufficient to perform the wellbore operation. In another embodiment, the base material 22 is substantially non-corrodible in the predetermined wellbore fluid 60 so that the modified article 40 may be used in the wellbore for an indefinite period of time. The second corrosion rate of the base material 42 in the predetermined wellbore fluid 60 may be any suitable rate that is lower than the first corrosion rate of the removable material 24, more particularly it may be lower by about one to about ten orders of magnitude, and more particularly by about three to about seven orders of magnitude. This may include corrosion rates of about 0.001 $mg/cm^2/hr$ to about 1.0 $mg/cm^2/hr$, for example.

The removable material 24 may include any material suitable for forming the base article 20 and which may be selectively removed from the base material 22, such as by a wellbore condition 50, including exposure to a suitable wellbore fluid 60, to form the modified article 40. In one embodiment, the removable material 24 may be provided in the form of a powder comprising a plurality of particles of the removable material 24 and may be formed into a powder compact of the removable material 24, or may be used as a loose powder as described herein. In another embodiment, the removable material 24 may be provided in the form of a powder comprising a mixture of a plurality of particles of the base material 22 and removable material 24 and may be formed into a powder compact of the base material 22 and the removable material 24. Any suitable removable material 24 may be used, including selectively corrodible metallic material; a dissolvable material, including an organic or inorganic salt; a phase change or active material, such as a magnetorheological (MR) or electrorheological (ER) material; or a phase change material, including a sublimable material; or a combination thereof.

In one embodiment, the removable material 24 may include plurality of corrodible metal powder particles dispersed within the base material 22. Each corrodible metal powder particle may include: a particle core, where the particle core comprises a core material comprising Mg, Al, Zn, Fe or Mn, or alloys thereof, or a combination thereof, and a nanoscale metallic coating layer disposed on the particle core. In one embodiment, the metallic coating layer may include Al, Zn, Mn, Mg, Mo, W, Cu, Fe, Si, Ca, Co, Ta, Re or Ni, or an oxide, carbide or nitride thereof, or a combination of any of the aforementioned materials, wherein the metallic coating layer 116 has a chemical composition and the particle core material 118 has a chemical composition that is different than the chemical composition of the metallic coating material, as described herein.

Figure 6:
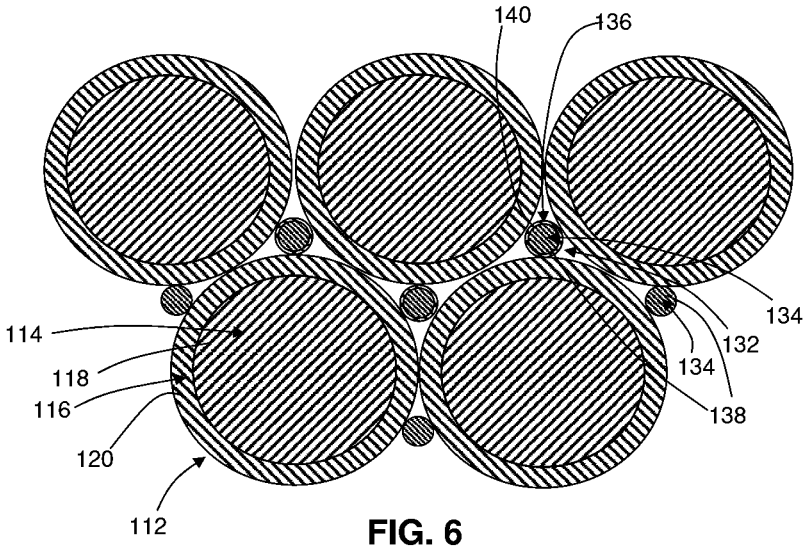
FIG. 6 is a schematic illustration of an exemplary embodiment of a powder and powder particles of a removable material as disclosed herein.
Figure 7:
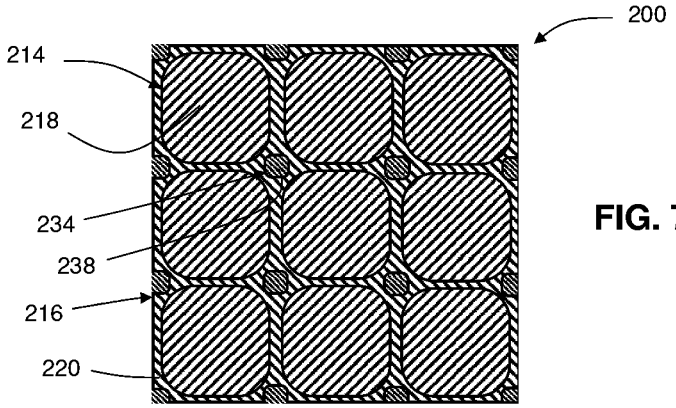
FIG. 7 is a schematic cross-sectional illustration of an exemplary embodiment of a powder compact of a removable material as disclosed herein.
Figure 8:
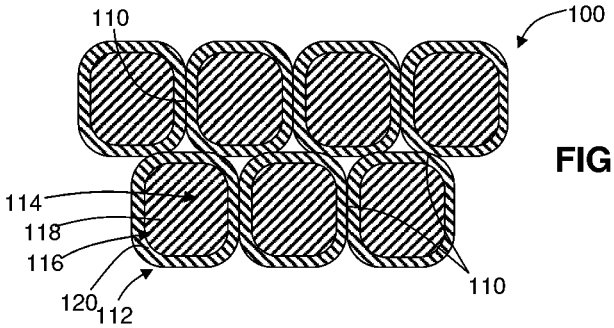
FIG. 8 is a schematic cross-sectional illustration of an exemplary embodiment of a precursor powder compact of a removable material as disclosed herein.

The base article 20 may comprise a selectively corrodible removable material 24. The removable material 24 may include a metallic material that may be selectively and rapidly corroded by a predetermined wellbore condition 50, including a predetermined wellbore fluid 60. More particularly, the selectively corrodible metallic material may include various metallic nanomatrix composite materials as described in commonly owned, co-pending U.S. patent application Ser. No. 12/633,682 filed on Dec. 8, 2009 and Ser. No. 12/913,310 filed on Oct. 27, 2010, which are incorporated herein by reference in their entirety. Referring to FIG. 6, the nanomatrix composites are compacts that may be formed from a metallic powder 110 that includes a plurality of metallic, coated powder particles 112. Powder particles 112 may be formed to provide a powder 110, including free-flowing powder, that may be poured or otherwise disposed in all manner of forms or molds (not shown) having all manner of shapes and sizes and that may be used to fashion precursor powder compacts 100 (FIG. 8) and powder compacts 200 (FIG. 7), as described herein, that may be used as, or for use in manufacturing, various articles of manufacture, including various wellbore tools and components. The powder 110 may, for example be mixed with a powder of the base material 22 to form a powder mixture, as described herein and formed into powder compacts 200 that may form, or be used as a precursor material to form, base articles 20 as described herein.

Each of the metallic, coated powder particles 112 of powder 110 includes a particle core 114 and a metallic coating layer 116 disposed on the particle core 114. The particle core 114 includes a core material 118. The core material 118 may include any suitable material for forming the particle core 114 that provides powder particle 112 that can be sintered to form a lightweight, high-strength powder compact 200 having selectable and controllable dissolution characteristics. In one embodiment, suitable core materials 118 include electrochemically active metals having a standard oxidation potential greater than or equal to that of Zn, and in another embodiment include Mg, Al, Mn, Fe or Zn, or alloys thereof, or a combination thereof. Core material 118 may also include other metals that are less electrochemically active than Zn or non-metallic materials, or a combination thereof. Suitable non-metallic materials include ceramics, composites, glasses or carbon, or a combination thereof. Core material 118 may be selected to provide a high dissolution rate in a predetermined wellbore fluid 60, but may also be selected to provide a relatively low dissolution rate, including zero dissolution, where dissolution of the nanomatrix material causes the particle core 114 to be rapidly undermined and liberated from the particle compact at the interface with the wellbore fluid 60, such that the effective rate of dissolution of particle compacts made using particle cores 114 of these core materials 118 is high, even though core material 118 itself may have a low dissolution rate, including core materials 118 that may be substantially insoluble in the wellbore fluid 60.

Each of the metallic, coated powder particles 112 of powder 110 also includes a metallic coating layer 116 that is disposed on particle core 114. Metallic coating layer 116 includes a metallic coating material 120. Metallic coating material 120 gives the powder particles 112 and powder 110 its metallic nature. Metallic coating layer 116 is a nanoscale coating layer. In an exemplary embodiment, metallic coating layer 116 may have a thickness of about 25 nm to about 2500 nm. The thickness of metallic coating layer 116 may vary over the surface of particle core 114, but will preferably have a substantially uniform thickness over the surface of particle core 114. Metallic coating layer 116 may include a single layer or a plurality of layers as a multilayer coating structure. Metallic coating material 120 may include any suitable metallic coating material 120 that provides a sinterable outer surface 121 that is configured to be sintered to an adjacent powder particle 112 that also has a metallic coating layer 116 and sinterable outer surface 121. In an exemplary embodiment of a powder 110, particle core 114 includes Mg, Al, Mn, Fe or Zn, or alloys thereof, or a combination thereof, as core material 118, and more particularly may include pure Mg and Mg alloys, and metallic coating layer 116 includes Al, Zn, Mn, Mg, Mo, W, Cu, Fe, Si, Ca, Co, Ta, Re, or Ni, or alloys thereof, or an oxide, nitride or a carbide thereof, or a combination of any of the aforementioned materials as coating material 120.

As used herein, the use of the term substantially-continuous cellular nanomatrix 216 does not connote the major constituent of the powder compact, but rather refers to the minority constituent or constituents, whether by weight or by volume. This is distinguished from most matrix composite materials where the matrix comprises the majority constituent by weight or volume. The use of the term substantially-continuous, cellular nanomatrix is intended to describe the extensive, regular, continuous and interconnected nature of the distribution of nanomatrix material 220 within powder compact 200. As used herein, "substantially-continuous" describes the extension of the nanomatrix material throughout powder compact 200 such that it extends between and envelopes substantially all of the dispersed particles 214. Substantially-continuous is used to indicate that complete continuity and regular order of the nanomatrix around each dispersed particle 214 is not required. For example, defects in the coating layer 116 over particle core 114 on some powder particles 112 may cause bridging of the particle cores 114 during sintering of the powder compact 200, thereby causing localized discontinuities to result within the cellular nanomatrix 216, even though in the other portions of the powder compact the nanomatrix is substantially continuous and exhibits the structure described herein. As used herein, "cellular" is used to indicate that the nanomatrix defines a network of generally repeating, interconnected, compartments or cells of nanomatrix material 220 that encompass and also interconnect the dispersed particles 214. As used herein, "nanomatrix" is used to describe the size or scale of the matrix, particularly the thickness of the matrix between adjacent dispersed particles 214. The metallic coating layers that are sintered together to form the nanomatrix are themselves nanoscale thickness coating layers. Since the nanomatrix at most locations, other than the intersection of more than two dispersed particles 214, generally comprises the interdiffusion and bonding of two coating layers 116 from adjacent powder particles 112 having nanoscale thicknesses, the matrix formed also has a nanoscale thickness (e.g., approximately two times the coating layer thickness as described herein) and is thus described as a nanomatrix. Further, the use of the term dispersed particles 214 does not connote the minor constituent of powder compact 200, but rather refers to the majority constituent or constituents, whether by weight or by volume. The use of the term dispersed particle is intended to convey the discontinuous and discrete distribution of particle core material 218 within powder compact 200.

Figure 17:
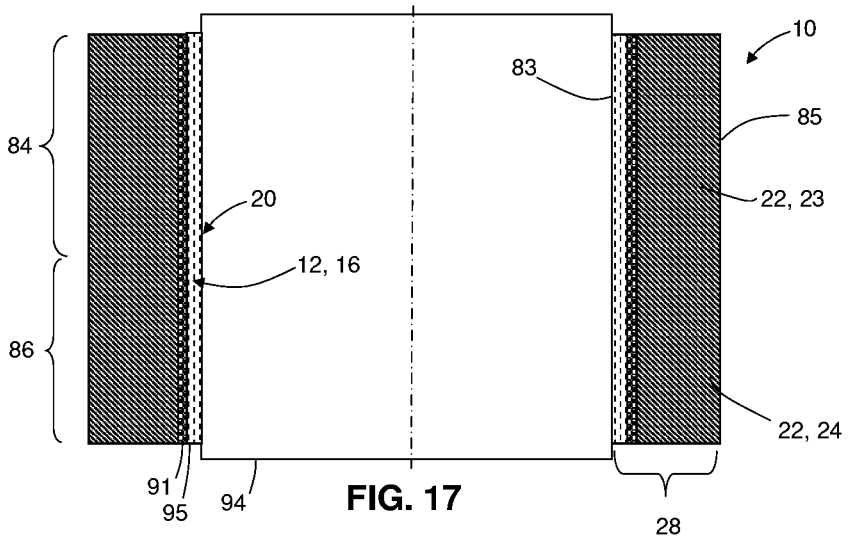
FIG. 17 is schematic cross-sectional illustration of an exemplary embodiment of a reconfigurable article comprising a porous wall section and defining a bearing as disclosed herein.

The equiaxed morphology of the dispersed particles 214 and cellular network 216 of particle layers results from sintering and deformation of the powder particles 112 as they are compacted and interdiffuse and deform to fill the interparticle spaces 115. The sintering temperatures and pressures may be selected to ensure that the density of powder compact 200 achieves substantially full theoretical density. Referring to FIG. 17, sintered powder compact 200 may comprise a sintered precursor powder compact 100 that includes a plurality of deformed, mechanically bonded powder particles as described herein. Precursor powder compact 100 may be formed by compaction of powder 110 to the point that powder particles 112 are pressed into one another, thereby deforming them and forming interparticle mechanical or other bonds associated with this deformation sufficient to cause the deformed powder particles 112 to adhere to one another and form a green-state powder compact having a green density that may be varied and is less than the theoretical density of a fully-dense compact of powder 110, due in part to interparticle spaces 115. Compaction may be performed, for example, by isostatically pressing powder 110 at room temperature to provide the deformation and interparticle bonding of powder particles 112 necessary to form precursor powder compact 100. The precursor powder compacts 100 and powder compacts 200 described herein may be formed herein entirely from the powder particles 112 of the removable material 24 only, or may include a mixture of a powder particles 112 of the removable material 24 and powder particles of a powder 102 of the base material 22, as described herein.

Sintered and dynamically forged powder compacts 200 that include dispersed particles 214 comprising Mg and nanomatrix 216 comprising various nanomatrix materials as described herein have demonstrated an excellent mechanical strength and low density. Dynamic forging as used herein means dynamic application of a load at temperature and for a time sufficient to promote sintering of the metallic coating layers 116 of adjacent powder particles 112, and may preferably include application of a dynamic forging load at a predetermined loading rate for a time and at a temperature sufficient to form a sintered and fully-dense powder compact 200. In an exemplary embodiment where particle cores 114 included Mg and metallic coating layer 116 included various single and multilayer coating layers as described herein, such as various single and multilayer coatings comprising Al, the dynamic forging was performed by sintering at a temperature, $T_S$, of about 450° C. to about 470° C. for up to about 1 hour without the application of a forging pressure, followed by dynamic forging by application of isostatic pressures at ramp rates between about 0.5 to about 2 ksi/second to a maximum pressure, $P_S$, of about 30 ksi to about 60 ksi, which resulted in forging cycles of 15 seconds to about 120 seconds.

Powder compacts 200 that include dispersed particles 214 comprising Mg and nanomatrix 216 comprising various nanomatrix materials 220 described herein have demonstrated room temperature compressive strengths of at least about 37 ksi, and have further demonstrated room temperature compressive strengths in excess of about 50 ksi. Powder compacts 200 of the types disclosed herein are able to achieve an actual density that is substantially equal to the predetermined theoretical density of a compact material based on the composition of powder 110, including relative amounts of constituents of particle cores 114 and metallic coating layer 116, and are also described herein as being fully-dense powder compacts 200. Powder compacts 200 comprising dispersed particles that include Mg and nanomatrix 216 that includes various nanomatrix materials as described herein have demonstrated actual densities of about 1.738 g/cm$^3$ to about 2.50 g/cm$^3$, which are substantially equal to the predetermined theoretical densities, differing by at most 4% from the predetermined theoretical densities. Powder compacts 200 comprising dispersed particles 214 that include Mg and cellular nanomatrix 216 that includes various nanomatrix materials as described herein demonstrate corrosion rates in 15% HCl that range from about 4750 mg/cm$^2$/hr to about 7432 mg/cm$^2$/hr. This range of response provides, for example the ability to remove a 3 inch diameter ball formed from this material from a wellbore by altering the wellbore fluid 60 in less than one hour.

The use of corrodible removable metallic materials 24 as described herein may be utilized with any suitable base material 22, particularly metallic, ceramic, polymeric or cementitious materials, or a combination thereof, as described herein. In one embodiment, the reconfigurable downhole article 10 includes a base material 22 comprising a cement and a removable material 24 comprising a plurality of corrodible metal powder particles 112 dispersed within the cement. The metal powder particles 112 may be removed by a predetermined wellbore fluid 60, such as a brine or an acid, to provide the modified article 40 comprising a porous cement comprising a plurality of dispersed pores corresponding to spaces previously occupied by the corrodible metal powder particles 112. In one embodiment, the plurality of dispersed pores comprises an open cell network of interconnected pores dispersed within the cement. In another embodiment, modified article 40 may include a fluid permeable cement.

The removable material 24 may also include a dissolvable material. Any suitable dissolvable material may be utilized, including various organic or inorganic salts, or a combination thereof. The dissolvable removable materials 24 as described herein may be utilized with any suitable base material 22, particularly many polymeric base materials 22, and more particularly cross-linkable polymeric materials, such as cross-linked polyethersulfones as described herein. In one embodiment, the base article 20 comprises a base material 22 having an open cell network of cell walls comprising a cross-linked polymer, particularly a polyethersulfone, and the removable material 24 comprises a salt disposed within the cell walls. The salt may be dissolved by a suitable solvent, including an aqueous solvent, and removed to provide a modified article 40 comprising an open cell network of cell walls, including an open-cell foam.

The removable material 24 may also include an active material, such as a magnetorheological (MR) or electrorheological (ER) material. Active materials may be incorporated by inserting any electro- or magneto-active fluid into a pore space as described herein. It then becomes the removable material. It is held in place by its electro- or magneto-active character and increased viscosity when activated and upon deactivation, the electro or magneto active fluid is allowed to be removed though normal fluid flow, diffusion, or solubility effects.

The removable material 24 may also include a phase change material, including a sublimable material, wherein the material may be removed by a phase change (e.g., sublimation). Examples of phase change materials include camphor, camphene or naphthalene, or combinations thereof. These materials can be used to form particulate slurries and then the slurry can be cast and then freeze dried to remove the removable material 24. The phase change removable materials 24 as described herein may be utilized with any suitable base material 22, particularly many particulate metallic, ceramic, polymeric and inorganic compound base materials 22. The base material 22 and removable material 24 may be formed as described herein, such as by forming a powder mixture of these materials which may be heated or compacted or otherwise formed into the base article as described herein.

Figure 9:
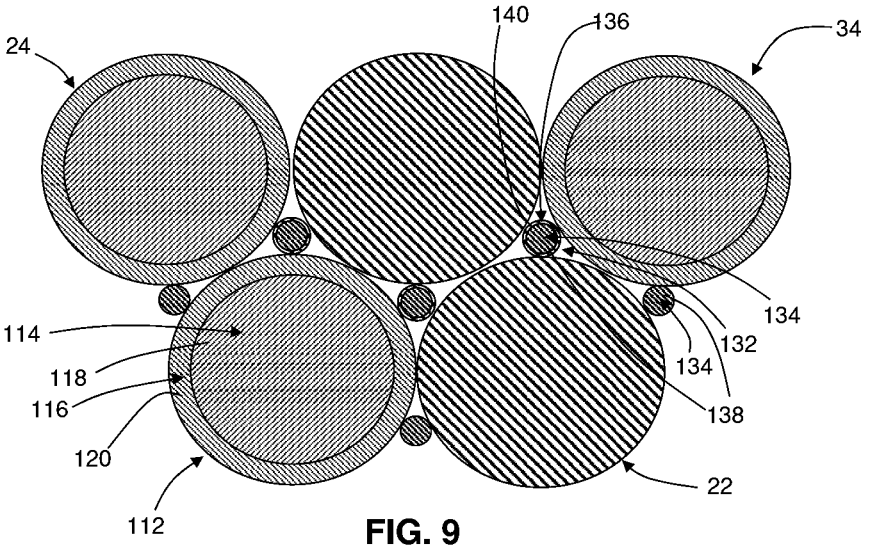
FIG. 9 is a schematic cross-sectional illustration of an exemplary embodiment of a powder mixture of powder particles of a removable material and base material as disclosed herein.
Figure 10:
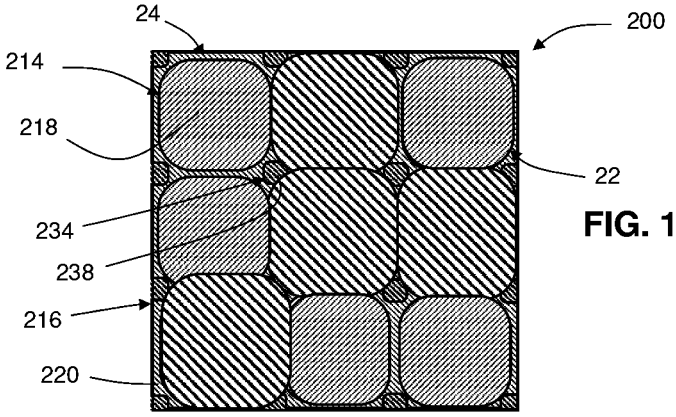
FIG. 10 is a schematic cross-sectional illustration of an exemplary embodiment of a reconfigurable article comprising a powder compact of a removable material and base material as disclosed herein.
Figure 11:
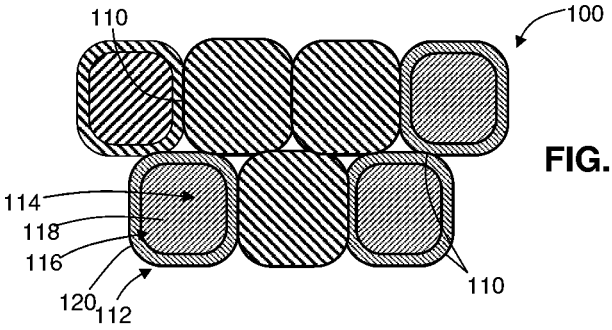
FIG. 11 is a schematic cross-sectional illustration of an exemplary embodiment of a reconfigurable article comprising a precursor powder compact of a removable material and base material as disclosed herein.

Referring to FIGS. 9-11, in certain embodiments, as described herein, wherein a powder 112 comprising powder particles of the removable material 24 are mixed with a powder 102 comprising powder particles of the base material 22 to form a powder mixture 34 (FIG. 9) that may be used to form the base article 20 as a powder compact 36, either as a precursor powder compact 100 (FIG. 11) or a powder compact 200 (FIG. 10) as described herein, the relative amounts of the particles and the particle sizes and shapes of both the removable material 24 particles and the base material 22 particles will be selected to provide the establishment of a matrix of the removable material 24 particles having base material 22 particles dispersed therein, and including in certain embodiments a cellular nanomatrix of the removable material 24 particles. The matrix of removable material 24 particles, such as a cellular nanomatrix, may be formed where a powder compact 200 of the particles are sintered to another and comprise chemical bonds formed by interdiffusion of the removable material 24 particles and the base material 22 particles or as a precursor power compact 100 where the particles are not sintered to another and comprise mechanical bonds formed by compaction of the particles. Whether sintered or unsintered, the compacted removable material 24 particles will preferably comprise a network of removable material 24 powder particles 112 joined to one another dispersed throughout the base material 22 particles which are also joined to one another to form a three-dimensional network of removable material 24 particles that are joined to one another intertwined with a three-dimensional network of base material 22 particles that are also joined to one another. Of course, the powder particles 112 of removable material 24 may, and generally will, be joined together with the powder particles of a powder of 102 of the base material 22. In one embodiment, at least a portion of the selectively removable particles are joined to one another or in touching contact with one another, and particularly greater than about 50% by volume of the removable material 24, and more particularly greater than about 75% by volume of the removable material 24, and even more particularly greater than about 90% by volume of the removable material 24, and most particularly substantially all of the removable material 24 particles are joined to one another or in touching contact with one another. The formation of the three-dimensional network of removable material 24 particles that are joined to one another or in touching contact with one another facilitates the selective corrodibility of the removable material 24 and interparticle electrochemical reactions that enable the corrosion or dissolution of the cellular nanomatrix 216 as well as release or corrosion of the dispersed core particles 214 by providing pathways by which the predetermined wellbore fluid 60 may penetrate the surface of the base article 20 to access the removable material 24 particles that are in the interior of the base article 20. In one example, this enable the predetermined wellbore fluid 60 to penetrate from the surface of the base article 20, including penetration through a wall section 28 of the base article 20 to remove at least a portion of the removable material 24 particles therein, and in some embodiments, substantially all of the removable material 24 particles.

Figure 12:
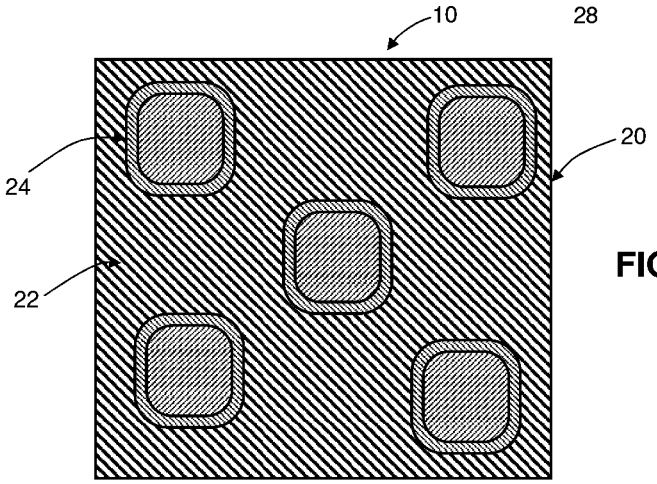
FIG. 12 is a schematic cross-sectional illustration of another exemplary embodiment of a reconfigurable article comprising a powder compact of a removable material and base material as disclosed herein.

In other embodiments, as illustrated generally in FIG. 12, the selectively removable corrodible particles are not joined to one another or in touching contact with one another, but rather are substantially dispersed from one another within the base material 22, such as a powder compact of the removable material 24 particles dispersed from one another within the base material 22 particles. In one embodiment, many of the selectively removable particles are not joined to one another or in touching contact with one another, and particularly comprise less than or equal to about 50% by volume of the removable material 24, particularly less than about 25% by volume of the removable material 24 particles, and most particularly substantially all of the removable material 24 particles are not joined to one another or in touching contact with one another. In these embodiments, there is substantially no three-dimensional network of removable material 24 particles that are joined to one another or in touching contact with one another to facilitate the selective corrodibility of the removable material 24 and no interparticle electrochemical reactions that enable the corrosion or dissolution of the cellular nanomatrix as well as release or corrosion of the dispersed core particles by providing pathways by which the predetermined wellbore fluid 60 may penetrate the surface of the base article 20 to access the removable material 24 particles that are in the interior of the base article 20. In these embodiments, the pathways for the predetermined wellbore fluid 60 may be provided through the matrix of the base material 22. In certain embodiments, the base material 22 may be permeable to the predetermined wellbore fluid 60, thereby providing a pathway to enable the fluid to contact the removable material 24 and selectively corrode or dissolve and remove the removable material 24. In other embodiments, the base article 20 may include porosity sufficient to provide access of the predetermined wellbore fluid 60 to the removable material 24, thereby providing a pathway to enable the fluid to contact the removable material 24 and selectively corrode or dissolve and remove the removable material 24. This also provides a path for the predetermined fluid to contact, corrode and thereby selectively remove the removable particles that are disposed within the base article 20, and are located internally away from the surface of the base article 20.

Upon removal of the removable material 24, the space formerly occupied by the removable material 24 comprises a predetermined porosity 11 with the base material 22, thereby defining the modified article 40. In embodiments where the removable material 24 comprises a three-dimensional network of removable material 24, the space comprises a three-dimensional network of porosity within a three-dimensional network of the base material 22. Appropriate selection of the particle shapes, sizes, amounts and distribution of the base material 22 and removable material 24 can be used to vary the nature of the predetermined porosity 11, including any porous network within the base material 22. In one embodiment, the predetermined porosity 11 may comprise a distributed porosity, including a closed or partially closed cellular structure, wherein the pores are separated from one another, similar to a closed-cell foam. Alternately, the predetermined porosity 11 may comprise an open or interconnected porous network structure, wherein the pores are interconnected, similar to an open-cell foam.

Reconfigurable articles 10 may include any articles for any intermediate or end use applications, but are particularly suitable for use as downhole articles, such as various downhole tools and components. Examples include, without limitation, various balls, plugs, sleeves, tubulars, screens, sieves, springs, or articles having internal, external or other features that can be affected by removal of a removable material 24, including recessed and protruding features, and more particularly including various substantially closed cavities, blind holes, through holes, shoulders, grooves, internal porosity 14, surface porosity 12, surface texture 16 and the like.

Figure 13:
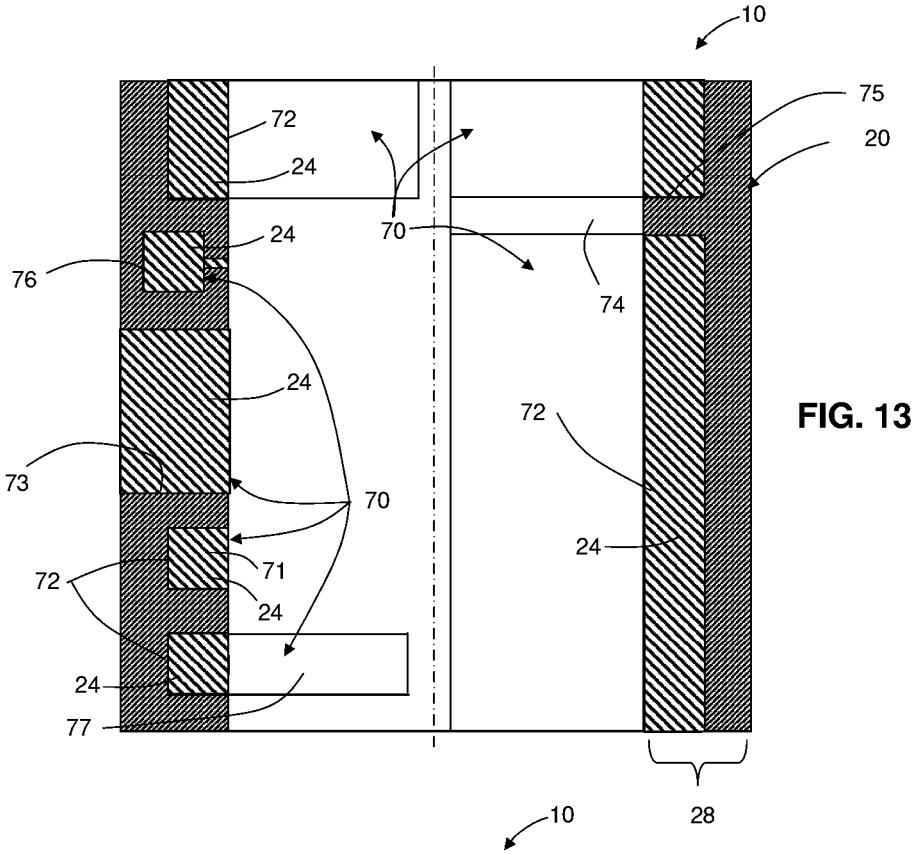
FIG. 13 is a schematic cross-sectional illustration of an exemplary embodiment of a reconfigurable article having features that may be defined using a removable material.

Referring to FIG. 13-20, in various embodiments the base article 20, such as a ball, plug, sleeve, tubular, screen, sieve or other article, may comprise a wall section 28 having a cylindrical, partially cylindrical, planar, spherical or other shape, and the modified article 40 may incorporate at least one feature 70, including a recessed 72, protruding 74 or internal feature 76, or a combination thereof, in the wall section 28, and more particularly may incorporate a substantially closed cavity 18 (FIG. 4D), blind hole 71, through-hole 73, shoulder 75, groove 77, internal porosity 14 (FIG. 2D), surface porosity 12 (FIG. 5D), surface texture 16 (FIG. 1D) and the like, or a combination thereof. Such features may be incorporated into any suitable downhole article, including various balls, plugs, sleeves, tubulars, screens, sieves and the like. More particularly, as shown in FIG. 13, in one embodiment a base article 20 may comprise a solid tubular section having no feature incorporated in the wall section and the modified article 40 may include a tubular section that incorporates one of the features described herein, either on an internal surface, an external surface or through the thickness of the wall section 28.

Figure 14A:
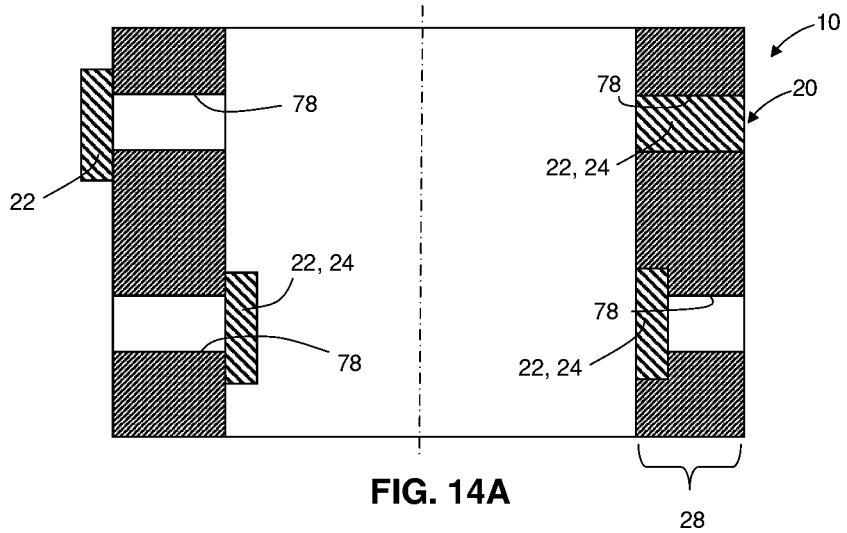
FIGS. 14A and 14B are schematic cross-sectional illustrations of an exemplary embodiment of a reconfigurable article comprising a screen or sieve as disclosed herein.
Figure 14B:
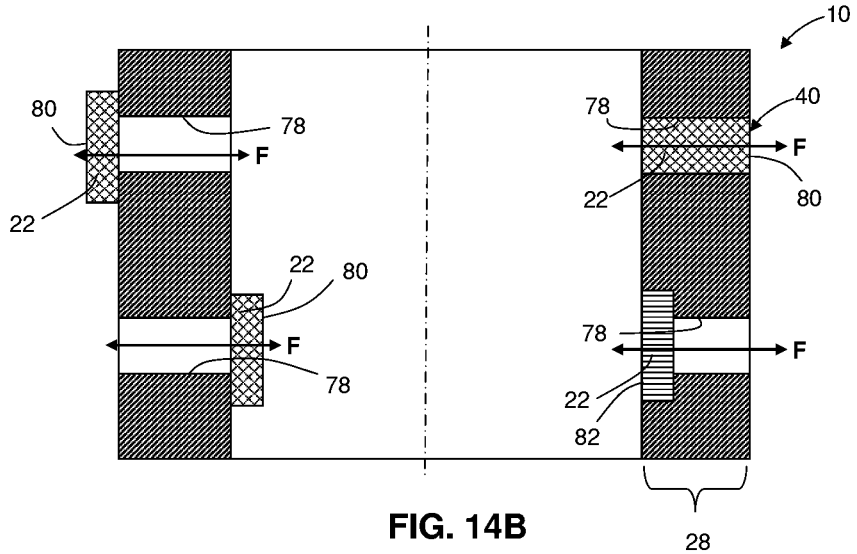

In another example, as shown in FIGS. 14A and 14B, the base article 20 may include solid tubular (FIG. 14A) that includes one or more through openings 78 in a wall section 28 having an insert comprising a powder compact 36 of base material 22 and removable material 24 configured to provide a screen 80 or sieve plate 82 covering the opening, such that the base article 20 may be reconfigured to provide a modified article 40 (FIG. 14B) having a plurality of through openings 78 that have integral screens 80 (e.g., mesh screens) or sieve plates 82 (e.g., plates with a plurality of openings of a predetermined size), such as various shaped through holes in the wall section. The screens 80 or sieve plates 82 may be attached to an internal or external surface of the wall section 28 proximate to and covering the openings, and may also be embedded within the removable material 24 so as to lie inside, outside or within the opening. Such a reconfigurable tubular article 10 with screen covered openings 78 in a wall section may be used, for example, in conjunction with completion operations, or in conjunction with various production operations. Advantageously, screen covered openings may be provided in situ using a wellbore fluid 60 only without the need for a separate downhole operation and associated time and material costs to run in a downhole article that includes the screened or sieve covered openings.

Figure 15A:
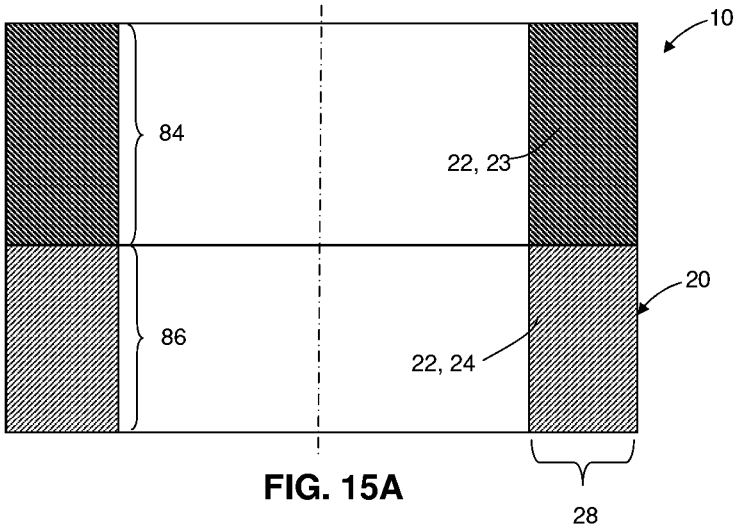
FIGS. 15A and 15B are schematic cross-sectional illustrations of an exemplary embodiment of a reconfigurable article comprising a porous wall section as disclosed herein.
Figure 15B:
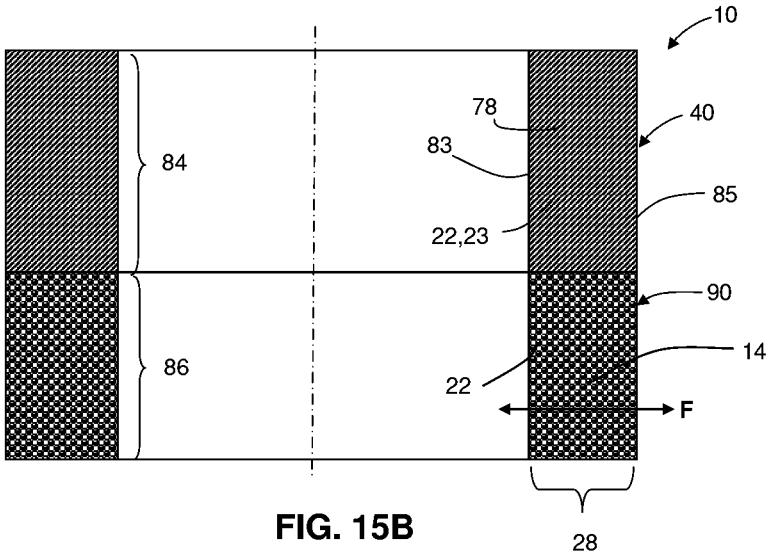

In another example, as shown in FIGS. 15A and 15B, the base article 20, such as a tubular, has a wall section 28 that includes a solid portion 84 of the base material 22, or alternately another material as may be associated with another article 23, and a porous portion 86 of the base material 22. In one exemplary embodiment, porous portion 86 of the base material 22 may comprise a network 90 of open, interconnected cells of the base material 22 filled with removable material 24 as described herein (FIG. 15A). Upon removal of removable material 24, the porous portion 86 of the base material 22 comprises internal porosity 14 comprising a network 90 of open, interconnected cells of the base material 22 (FIG. 15B). The porous portion 86 of the base material 22 may comprise internal porosity 14 that may in one embodiment extend through the wall section 28 from an internal surface 83 to an external surface 85. The porous network may have a predetermined pore size and distribution of open, interconnected cells of the base material 22 and the porous portion 86 may define a filter medium or porous barrier that enables flow of a fluid (F), such as a drilling, completion or production fluid, through the wall section 28 either into or out of the wellbore.

Figure 16A:
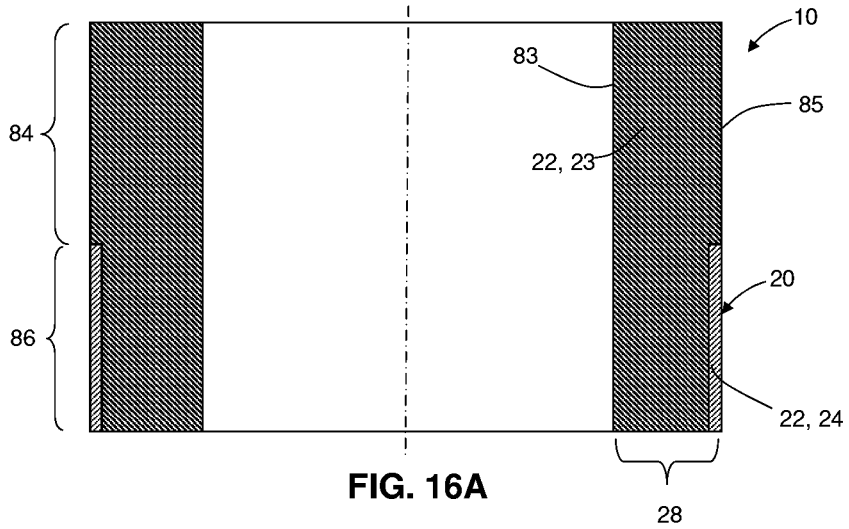
FIGS. 16A and 16B are schematic cross-sectional illustrations of an exemplary embodiment of a reconfigurable article comprising a surface porosity or surface texture as disclosed herein.
Figure 16B:
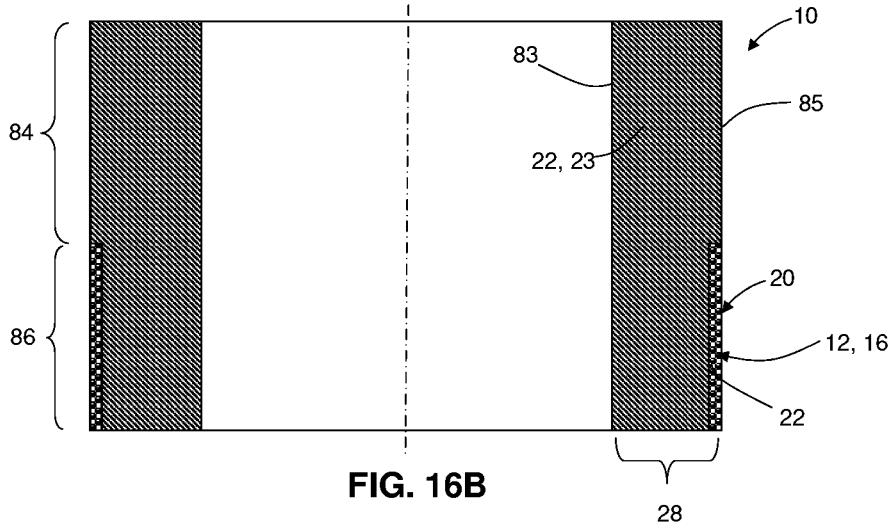

In another exemplary embodiment as shown in FIGS. 16A and 16B, the removable material 24 may be applied (FIG. 16A) to an internal surface 83 or an external surface 85 of the wall section 28 (or both) and upon removal (FIG. 16B) the porous portion 86 of the base material 22 may comprise surface porosity 12 that may, in one embodiment, define an internal surface 83 or an external surface 85 of the wall section 28. The porosity may have any porous structure and define a network 90 of open cell or closed cell pores, or a combination of open and closed cell pores. The porous network 90 may have a predetermined pore size and distribution of open or closed cell pores in base material 22. Alternately, the porous portion 86 may include a removable material 24 and base material to define a surface texture 16 as described herein.

Figure 18:
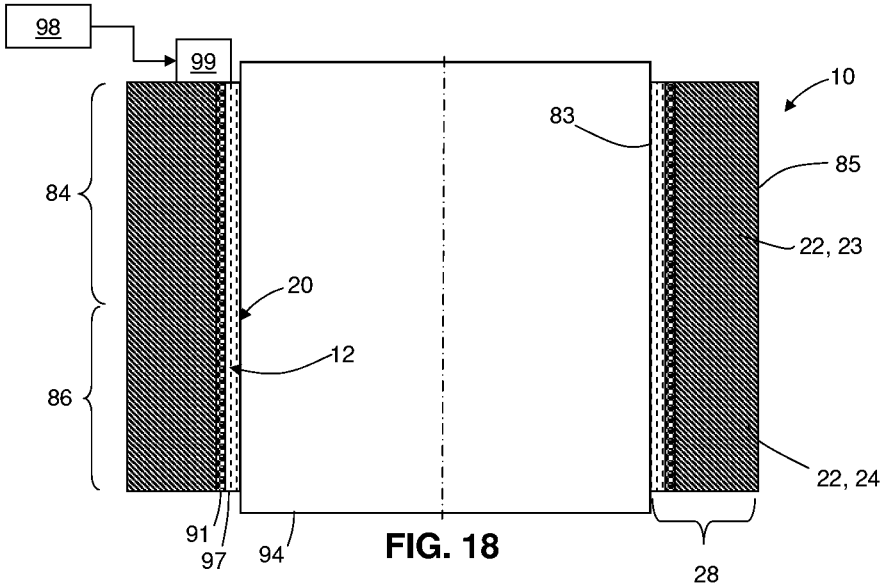
FIG. 18 is schematic cross-sectional illustration of an exemplary embodiment of a reconfigurable article comprising a porous wall section and defining a clutch or brake as disclosed herein.

In an exemplary embodiment as shown in FIG. 17, the porous portion 86 of the base material 22 may define a bearing 91 or bushing, such as may be employed to support a rotatable shaft 94, and the cell structure of the article 10 may be employed to retain a lubricant medium 95. Alternately, as shown in FIG. 17, the cell structure may be employed to provide a surface having a predetermined surface roughness or surface texture 16 which may be used to control the coefficient of friction, including rolling or sliding friction, of an internal surface 83 or an external surface 85 of the wall section 28, such as the wall section 28 of a tubular, sleeve or other downhole tool or component. In another exemplary embodiment as shown in FIG. 18, the cell structure may be employed to retain an active material fluid 97, such as a magnetorheological (MR) or electrorheological (ER) fluid, which may be used in conjunction with a rotatable shaft 94 to couple the rotation of the shaft 94 to the porous portion 86 of the wall section 28 in order to provide a braking or a clutching response to the shaft 94 and/or wall section 28 by altering the viscosity or other fluid properties by controlled application of a magnetic or electric field, respectively, to the fluid. Such control may be affected, for example, by using a suitable microprocessor-based controller 98 that is in signal communication with an actuator 99 that is configured to apply a suitable field, i.e. a magnetic field or electric field, to the active material fluid 97 and controllably alter the rheological, particularly the viscoelastic, properties of the fluid. Alternately, as shown in FIG. 17, the cell structure may be employed to provide a surface having a predetermined surface roughness or surface texture 16 which may be used to control the coefficient of friction, including rolling or sliding friction, of an internal surface 83 or an external surface 85 of the wall section 28, such as the wall section 28 of a tubular, sleeve or other downhole tool or component.

Figure 19A:
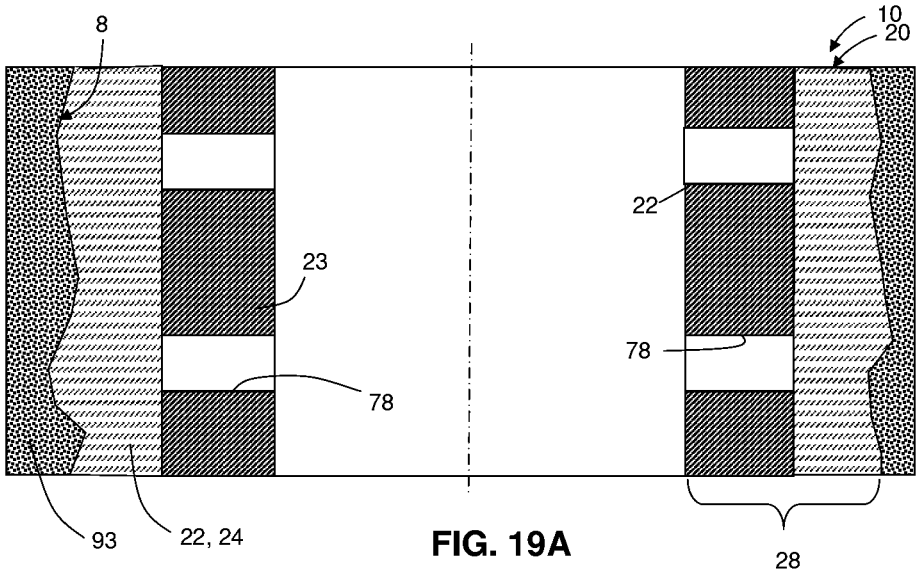
FIGS. 19A and 19B are schematic cross-sectional illustrations of an exemplary embodiment of a reconfigurable article comprising a porous cement as disclosed herein.
Figure 19B:
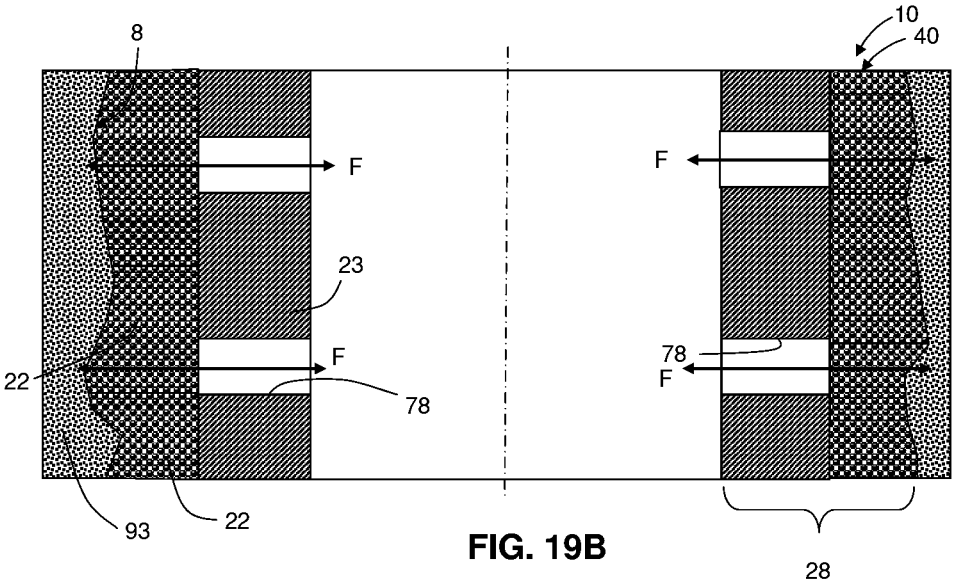

In yet another example as shown in FIGS. 19A and 19B, the base material 22 and the removable material 24 may be mixed together to form a mixture 34, including various homogeneous mixtures, heterogeneous mixture, as well as mixtures 34 wherein the base material 22 and removable material 24 comprise a cement composition, as described herein. These cement composition mixtures may be formed into any suitable free-standing shape or form that defines the desired base article 20 in the wellbore, such as, for example, a liner, packing or plug formed on the outer annulus of a tubular well casing in an unconsolidated formation. The base article 20 may also be disposed on, proximate to or within, or a combination thereof, another article 23 that is formed from another material that is different than the base material 22, such as the exterior of a well casing 92. In an exemplary embodiment as shown in FIG. 19, the base article 20 may be disposed on the other article so as to conform to a surface 25 of the other article 23. The removable material 24 may then be removed to form the modified article 40. In an exemplary embodiment, the base material 22 and removable material 24 may be intermixed so that the base material 22 is configured to form a modified article 40 having an interconnected, open cell network 90 of the base material 22, in this cement, upon removal of the removable material 24 and may have any free-standing shape or form, including shapes or forms that are the same as or different than that of the base article 20. The porous network 90 may have a predetermined pore or cell size and distribution of open, interconnected cells of the base material 22 and may define a filter medium or porous, fluid permeable barrier. The filter medium may be a stand-alone filter or may be disposed on or within another article 23 as a substrate, including as a conformable filter medium that conforms to a surface of another article 23.

The reconfigurable articles 10 disclosed herein may be used as any suitable article for any suitable application, and more particularly are useful as reconfigurable downhole articles 10, including reconfigurable downhole tools and components. In some embodiments, the reconfigurable downhole articles 10 may be reconfigured from the base article 20 to the modified article 40 downhole in the wellbore in conjunction with drilling, completion or production operations. In other embodiments, reconfigurable downhole articles 10 may be reconfigured prior to downhole placement.

Figure 20:
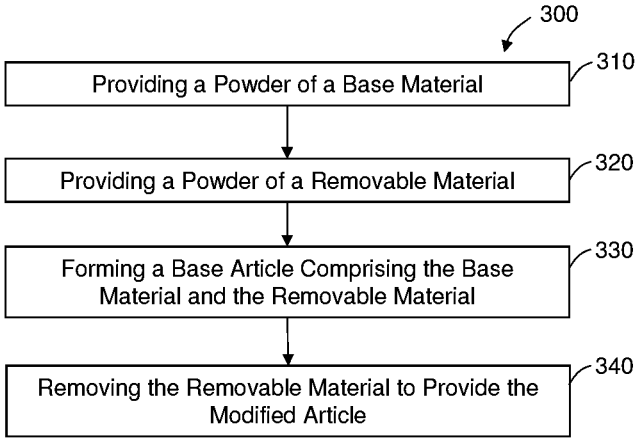
FIG. 20 is a flowchart of an exemplary embodiment of a method of making a reconfigurable article as disclosed herein.

The reconfigurable articles 10 disclosed herein may be made by any suitable method. Referring to FIG. 20, an exemplary embodiment of a method 300 of making a reconfigurable article 10 is disclosed. The method includes providing 310 a powder comprising a plurality of base material 22 particles; providing 320 a powder comprising a plurality of removable material 24 particles and forming 330 a base article 20 from the base material 22 particles comprising a plurality of removable material 24 particles. The method also may include removing 340 the removable material 24 from the base article 20 to provide a modified article 40.

Providing 310 a powder of a base material 22 may be performed by any suitable method of making a powder of the base material 22, and will generally depend on the type of base material 22 selected. This may include various conventional pulverizing, size classification, crushing, grinding, sorting, atomization, electrolysis, spin casting, laser ablation, chemical and other powder forming methods. The base materials 22 may be selected to provide a suitable combination of material properties for the article 10, such as strength, toughness, wear resistance, corrosion resistance, tribological properties and the like. The base material 22 may also be selected in conjunction with the removable material 24 to facilitate their processing to form the base article 20 or the removal of the removable material 24 from the base article 20 or other characteristics of the base article 20. In an exemplary embodiment, the base material 22 will also be selected to be resistant to corrosion from various wellbore fluids 60, particularly those used to remove the removable material 24, as described herein.

Providing 320 a powder comprising a plurality of removable material 24 particles may be performed by any suitable method of making a powder of the removable material 24 particles, and will generally depend on the type of removable material 24 particles selected. The methods describe above for making a powder of the base material 22 may be employed as well as other methods. In an exemplary embodiment, providing 320 a powder comprising a plurality of removable material 24 particles may include forming a coated metallic powder comprising powder particles 112 having particle cores 114 with nanoscale metallic coating layers 116 disposed thereon. The nanoscale metallic coating layers 116 may be disposed on the plurality of particle cores using any suitable deposition method, including various thin film deposition methods, such as, for example, chemical vapor deposition and physical vapor deposition methods. In an exemplary embodiment, depositing of metallic coating layers is performed using fluidized bed chemical vapor deposition (FBCVD). Depositing of the metallic coating layers by FBCVD includes flowing a reactive fluid as a coating medium that includes the desired metallic coating material through a bed of particle cores fluidized in a reactor vessel under suitable conditions, including temperature, pressure and flow rate conditions and the like, sufficient to induce a chemical reaction of the coating medium to produce the desired metallic coating material and induce its deposition upon the surface of particle cores to form coated powder particles. The reactive fluid selected will depend upon the metallic coating material desired, and will typically comprise an organometallic compound that includes the metallic material to be deposited such as nickel tetracarbonyl ($Ni(CO)_4$), tungsten hexafluoride ($WF_6$), and triethyl aluminum ($C_6H_{15}Al$), that is transported in a carrier fluid, such as helium or argon gas. The reactive fluid, including carrier fluid, causes at least a portion of the plurality of particle cores to be suspended in the fluid, thereby enabling the entire surface of the suspended particle cores to be exposed to the reactive fluid, including, for example, a desired organometallic constituent, and enabling deposition of metallic coating material and coating layers 116 over the entire surfaces of particle cores 114 such that they each become enclosed forming coated particles having metallic coating layers, as described in the co-pending patent applications incorporated by reference herein. As also described herein, each metallic coating layer may include a plurality of coating layers. Coating material may be deposited in multiple layers to form a multilayer metallic coating layer by repeating the depositing described above and changing the reactive fluid to provide the desired metallic coating material for each subsequent layer, where each subsequent layer is deposited on the outer surface of particle cores that already include any previously deposited coating layer or layers that make up metallic coating layer. The metallic coating materials of the respective layers may be different from one another, and the differences may be provided by utilization of different reactive media that are configured to produce the desired metallic coating layers on the particle cores in the fluidize bed reactor. The metallic coating layers may include single-layer metallic coating layers or multilayer metallic coating layers as described herein. Applying the metallic coating layers 116 may also include controlling the thickness of the individual layers as they are being applied, as well as controlling the overall thickness of metallic coating layers 116. Particle cores 114 may be formed using the methods described above. Providing 320 a powder comprising a plurality of removable material 24 particles by forming a coated metallic powder comprising powder particles having particle cores with nanoscale metallic coating layers disposed thereof is particularly desirable when the base material 22 particles comprise metal particles, and even more desirable when the base material 22 particles have a standard oxidation or corrosion potential in an aqueous environment greater than that of the removable material 24.

In another exemplary embodiment, providing 320 a powder comprising a plurality of removable material 24 particles may include forming a powder of a salt, including an organic or inorganic salt, and more particularly may include forming a powder comprising a plurality of particles of sodium chloride. Sodium chloride is particularly useful as a removable material 24 for use in conjunction with a polymer base material 22, and more particularly for use with a polyethersulfone polymer base material 22, and even more particularly for a polyethersulfone polymer base material 22 that is configured for cross-linking upon thermal activation by heating as described herein.

Forming 330 a base article 20 from the base material 22 particles comprising a plurality of removable material 24 particles may be performed using any suitable powder forming method, depending on the base material 22 particles and removable material 24 particles selected and the nature of the article desired, such as whether the base article 20 requires a homogenous mixture of base material 22 particles and removable material 24 particles, or whether the nature of the article requires that the base material 22 particles and removable material 24 particles be separated or arranged in a heterogeneous mixture as described further herein. The powder of the base material 22 may be heated or compacted or both during forming 330 of the base article 20 as described herein and the particles of the base material 22 and removable material 24 may become sintered to one another by various chemical and physical bonding processes, including interdiffusion of their respective constituent elements. In an exemplary embodiment, the composition of the base material 22 remains substantially the same during forming 330 as the particles of the base material 22 are sintered to one another to form the base article 20, and the composition of the particles of the removable material 24 remains substantially the same during forming 330 as the particles of the removable material 24 are sintered to one another to form the base article 20.

In an exemplary embodiment, forming 330 may include mixing the powder of the base material 22 particles and the removable material 24 particles to form a particle mixture; and forming the particle mixture to provide the base article 20. Mixing may be performed by any suitable powder mixing method, including the use of various types of mixing devices. In one embodiment, this may include using batch mixing devices to make a bulk homogeneous mixture. In another embodiment, mixing may also include deposition, including co-deposition, of powders of the base material 22 and removable material 24, such as by various spraying methods. In yet another embodiment, mixing may also include using devices that are able to deposit the base material 22 particles and removable material 24 particles separately in a predetermined arrangement, such as a three-dimensional spacing, arrangement or order of both types of particles, and particularly may provide a pre-determined arrangement that provides a bonded network of base material 22 particles upon forming and creates a modified article 40 that includes a predetermined porosity 11 or surface texture 16 upon removal of the removable material 24 particles, as described herein. Mixing may also include providing a predetermined pattern or patterns of removable material 24 particles in the base material 22 particles that may be used, upon forming and removal of the removable material 24 particles, to form various patterned features in the modified article 40, as described herein. As used herein, mixing may include application of a layer or layers of the removable material 24 particles on or in the base material 22 particles, such as, for example, where the removable material 24 particles form a layer on the base material 22 particles that, upon forming will define an outer surface of the base article 20. In yet another embodiment, mixing 150 may also include forming a slurry of a cement and water and removable material 24.

In one embodiment, forming may include any suitable method of forming the base material 22 particles and the removable material 24 particles to form the base article 20. Forming the particle mixture may include heating the particle mixture, whether compacted or uncompacted, to a temperature and for a time sufficient to cause the base material 22 particles and the removable material 24 particles to become sintered together, by various chemical or physical bonding processes, interdiffusion processes or otherwise, to form the base article 20 without the application of pressure during heating to compact the particles together. Examples include heating of the base material 22 particles and the removable material 24 particles comprising various metals, ceramics, polymers or inorganic materials to form the base article 20. This may include various melting, sintering, diffusion bonding and other heating methods.

Forming the particle mixture may also include compacting the particle mixture by applying pressure, such as by isostatic pressing without the application of heat or cold isostatic pressing. Heating and compacting may also be combined in any order. In one exemplary embodiment, method 300 includes heating the particle mixture during compacting, such as occurs during injection molding, compression molding, transfer molding, structural foam molding, blow molding, rotational molding, hot isostatic pressing, extrusion, dynamic forging and the like. In another exemplary embodiment; method includes heating after compacting to a temperature and for a time sufficient to cause the base material 22 particles and the removable material 24 particles to interdiffuse and become sintered together and form the base article 20. Compacting prior to sintering places the particles in closer proximity to one another and enhances the chemical or physical bonding, or both, of the particles, as well as interdiffusion processes, and increases the density of the resultant base article 20. Compacting the particle mixture may include any suitable compaction method, including extrusion; injection molding; compression molding; transfer molding; structural foam molding; blow molding; rotational molding; powder pressing, including cold isostatic pressing or hot isostatic pressing, or a combination thereof; forging, including dynamic forging; rolling; or a combination thereof. In another embodiment, forming may include a pouring and curing of a cement composition comprising a mixture of base material 22 particles and removable material 24 particles into a form to shape them, including into a portion of the wellbore to be shaped thereby. In one embodiment, a cement composition a mixture of base material 22 particles and removable material 24 particles may be formed as a poured liner configured to receive a tubular well casing 92, as illustrated in FIG. 19A.

Method 300 also may optionally or alternately or selectively include removing 340 the removable material 24 from the base article 20 to reconfigure article 10 and provide a modified article 40. Removing 340 is described as optional or alternate or selective due to the fact that the reconfigurable article 10 may be used in certain embodiments over its entire operating lifetime in the base article 20 configuration, and may not be reconfigured at all except in the event of a predetermined condition that may not occur, such as a predetermined emergency condition that may occur, but is not expected to occur. In other embodiments, the reconfigurable article 10 may be used in the base article 20 configuration to be run into the wellbore and then reconfigured by removal of removable material 24 to form modified article 40, either immediately or after a predetermined time period sufficient to complete one or more wellbore operations or upon occurrence of a predetermined wellbore condition 50 that may be selectively controlled, or that may not be directly controlled but is expected to occur. In some embodiments, removing 340 of removable material 24 from the base article 20 will form a modified article 40 that includes different features or shape or is configured to perform a different function as disclosed herein. In other embodiments, the base article 20 will form a modified article 40 that includes the same features or is configured to perform the same function, but may have a different size. Removing 340 of the removable material 24 may be performed in response to expose of the article to any suitable predetermined wellbore condition 50. Suitable predetermined wellbore conditions may include exposure of the reconfigurable article 10 to a predetermined pressure, temperature, wellbore fluid 60 or other wellbore condition, or a combination thereof. Any suitable predetermined wellbore fluid may be used to remove the removable material, including various drilling, completion and production fluids, and more particularly including water, an aqueous chloride solution, a brine, a formation fluid, an inorganic acid, an organic acid, and combinations thereof.

Figure 21:
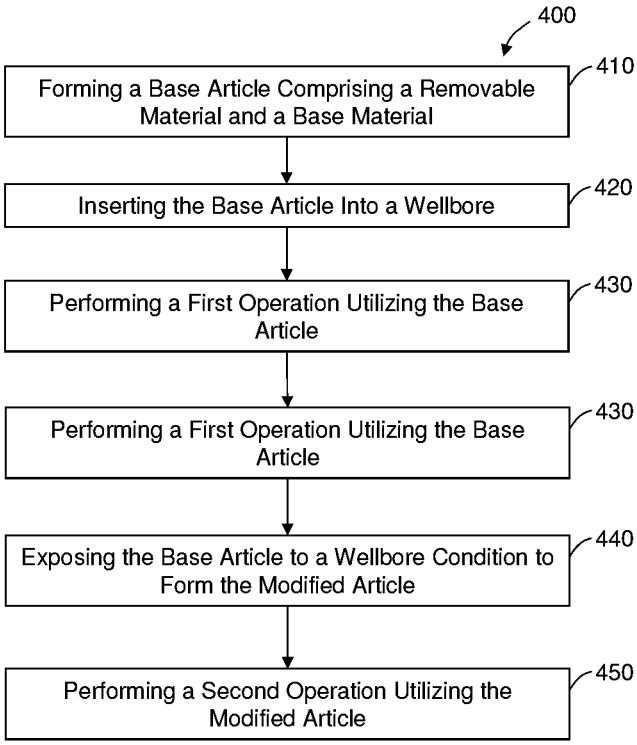
FIG. 21 is a flowchart of an exemplary embodiment of a method of using a reconfigurable article as disclosed herein.

Referring to FIG. 21, a method 400 of using a reconfigurable article 10 is also disclosed herein, and is particularly adapted for downhole applications and use of downhole tools and components. The method 400 includes forming 410 a base article 20, the base article 20 comprising a base material 22 and a removable material 24, including a powder compact 36 of these materials, wherein the base article 20 comprises a downhole tool or component. The method 400 also includes inserting 420 the base article 20 into a wellbore 8 (FIGS. 19A and 19B). The method also includes performing 430 a first operation utilizing the base article, which may include any suitable operation including passage of fluids or wellbore tools or components through the base article 20. The method also includes exposing 440 the removable material 24 of the base article 20 to a wellbore condition 50 that is configured to remove the removable material 24 and form a modified article 20. The method 400 also includes performing 450 a second operation using the modified article 40, such as, for example, recovery of a formation fluid from the wellbore. Aspects of the method 400 are also illustrated and described herein in conjunction with the other figures, particularly FIGS. 1A-5D and 13-19B.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A method of making a reconfigurable article, comprising:

providing a powder comprising a plurality of base material particles, the base material particles comprising base metal particles;

providing a powder comprising a plurality of removable material particles, each removable material particle comprising a particle core, the particle core comprising a core material that comprises Mg, Al, Zn or Mn, or a combination thereof, and a metallic coating layer disposed on the particle core and comprising a metallic coating material, wherein the powders are configured for solid-state sintering to one another at a predetermined sintering temperature; and forming a base article from the base material particles comprising the plurality of removable material particles, the forming comprising mixing the base material particles and the removable material particles to form a particle mixture and compacting or heating, or a combination thereof, the particle mixture to provide the base article.

2. The method of claim 1, wherein heating and compacting of the removable metallic particles forms a cellular nanomatrix of the metallic coating material having a plurality of dispersed particles comprising the particle core material, dispersed in the cellular nanomatrix; and a bond layer extending throughout the cellular nanomatrix between the dispersed particles.

3. The method of claim 2, wherein the metallic coating material comprises Al, Zn, Mn, Mg, Mo, W, Cu, Fe, Si, Ca, Co, Ta, Re or Ni, or an oxide, carbide or nitride thereof, or a combination of any of the aforementioned materials, and wherein the metallic coating material has a chemical composition and the particle core material has a chemical composition that is different than the chemical composition of the metallic coating material.

4. The method of claim 1, wherein forming the particle mixture comprises heating the particle mixture, and wherein the particle core has a melting temperature ($T_P$), the metallic coating material has a melting temperature ($T_{Cc}$), and the predetermined sintering temperature ($T_S$) is less than $T_P$ and $T_C$.

5. The method of claim 1, wherein forming the particle mixture comprises compacting the particle mixture.

6. The method of claim 5, further comprising heating the particle mixture during compacting; or heating after compacting to form the base article; or a combination thereof.

7. The method of claim 5, wherein compacting the particle mixture comprises extrusion, injection molding, compression molding, transfer molding, structural foam molding, blow molding, rotational molding, hot isostatic pressing or dynamic forging.

8. The method of claim 1, wherein the base material comprises a polymer, metal, ceramic or inorganic compound, or a combination thereof.

9. The method of claim 1, wherein the removable material comprises a polymer, metal, ceramic or inorganic compound, or a combination thereof.

10. The method of claim 1, wherein the base article comprises a downhole tool or component.

11. The method of claim 1, further comprising removing the removable material from the base article to provide a modified article.

12. The method of claim 11, wherein the base article comprises a downhole tool or component and the modified article comprises a downhole tool or component that is different than the downhole tool or component provided by the base article.

13. The method of claim 11, wherein the modified article has at least one of a surface porosity, internal porosity or surface texture, or a combination thereof, formed by removal of the removable material.

14. The method of claim 11, wherein removing the removable material is performed by exposing the base article to a wellbore fluid.

15. The method of claim 11, wherein the wellbore fluid is selected from a group consisting of water, an aqueous chloride solution, an inorganic acid, an organic acid, and combinations thereof.

* * * * *